US010436553B2

(12) United States Patent
Moore et al.

(10) Patent No.: US 10,436,553 B2
(45) Date of Patent: Oct. 8, 2019

(54) MASTER MODULE LIGHT SOURCE AND TRAINER

(71) Applicant: CRIMSON TRACE CORPORATION, Wilsonville, OR (US)

(72) Inventors: Larry E. Moore, Cottonwood, AZ (US); Aaron Moore, Cottonwood, AZ (US)

(73) Assignee: Crimson Trace Corporation, Wilsonville, OR (US)

( * ) Notice: Subject to any disclaimer, the term of this patent is extended or adjusted under 35 U.S.C. 154(b) by 0 days.

(21) Appl. No.: 14/963,475

(22) Filed: Dec. 9, 2015

(65) Prior Publication Data

US 2016/0161220 A1 Jun. 9, 2016

Related U.S. Application Data

(63) Continuation-in-part of application No. 14/459,274, filed on Aug. 13, 2014, now Pat. No. 9,297,614.

(51) Int. Cl.
*F41G 3/26* (2006.01)
*F41G 1/35* (2006.01)

(52) U.S. Cl.
CPC ..... *F41G 3/2655* (2013.01); *F41G 1/35* (2013.01)

(58) Field of Classification Search
CPC ..... F41G 3/2655; F41G 1/35; F41G 11/003; F41G 1/36; F41G 11/001; F41G 1/34; F41G 1/00; F41G 11/00; F41G 1/46; F41G 3/08; F41C 27/00; F41C 33/0254; F41A 33/02; F41A 19/11; F21Y 2103/10; F21L 4/00
USPC ..... 42/117
See application file for complete search history.

(56) References Cited

U.S. PATENT DOCUMENTS

| | | | | |
|---|---|---|---|---|
| 1,490,272 A | | 4/1924 | Hickam | |
| 1,898,566 A | * | 2/1933 | Albert | F41A 21/10 42/77 |
| 2,268,056 A | * | 12/1941 | Nelson | F41A 33/02 362/112 |
| 2,308,627 A | | 1/1943 | Rickenbacher | |
| 2,357,951 A | * | 9/1944 | Hale | F41B 11/51 124/53.5 |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

USPTO; Notice of Allowance dated Nov. 15, 2016 in U.S. Appl. No. 14/630,467.

(Continued)

*Primary Examiner* — Joshua E Freeman
*Assistant Examiner* — Bridget A Cochran
(74) *Attorney, Agent, or Firm* — Schwabe Williamson & Wyatt, P.C.

(57) ABSTRACT

A device incorporates a light source, a power source, and a control unit. The device has two operating modes and a switch to select one of the two modes. In a first operating mode the light source has a first control function wherein it emits light and a second control function wherein it does not emit light. In a second mode the light source emits light when the sound of a gun firing pin is detected.

23 Claims, 26 Drawing Sheets

(56) References Cited

U.S. PATENT DOCUMENTS 2,430,469 A * 11/1947 Karnes ..... F41G 1/32 250/467.1
2,597,565 A * 5/1952 Chandler ..... F41C 23/16 362/110
2,701,930 A 2/1955 Dolan
2,773,309 A 12/1956 Elliot
2,780,882 A 2/1957 Temple
2,826,848 A 3/1958 Davies
2,844,710 A 7/1958 Rudolf
2,894,117 A 7/1959 Koskey
2,904,888 A 9/1959 Niesp
2,926,916 A 3/1960 Pearson
3,104,478 A * 9/1963 Strauss ..... F41G 3/26 250/342
3,112,567 A 12/1963 Flanagan
3,192,915 A 7/1965 Norris et al.
3,284,905 A 11/1966 Simmons
3,510,965 A 5/1970 Rhea
3,526,972 A 9/1970 Sumpf
3,573,868 A 4/1971 Giannetti
3,618,673 A 11/1971 Gossett
3,633,285 A * 1/1972 Sensney ..... F41G 3/2655 42/114
3,641,676 A 2/1972 Knutsen et al.
3,645,635 A 2/1972 Steck
3,748,751 A * 7/1973 Breglia ..... F41G 3/2627 434/21
3,801,205 A 4/1974 Eggenschwyler
3,813,795 A * 6/1974 Marshall ..... F41G 3/2655 42/114
3,914,873 A 10/1975 Elliot, Jr. et al.
3,948,522 A * 4/1976 Fixler ..... A63B 69/3614 463/51
3,992,783 A 11/1976 Dunlap et al.
3,995,376 A 12/1976 Kimble et al.
4,026,054 A 5/1977 Snyder
4,048,489 A * 9/1977 Giannetti ..... F41A 33/02 362/110
4,063,368 A * 12/1977 McFarland ..... F41G 3/2655 434/22
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 De Filippis et al.
4,234,911 A 11/1980 Faith
4,295,289 A 10/1981 Snyder
4,305,091 A 12/1981 Cooper
4,346,530 A 8/1982 Stewart
4,348,828 A 9/1982 Snyder
4,352,665 A 10/1982 Kimble et al.
4,452,458 A * 6/1984 Timander ..... F41G 3/2605 42/114
4,481,561 A 11/1984 Lanning
4,487,583 A 12/1984 Brucker
4,488,369 A 12/1984 Van Note
4,541,191 A 9/1985 Morris et al.
4,567,810 A 2/1986 Preston
4,662,845 A 5/1987 Gallaher
4,713,889 A 12/1987 Santiago
4,763,431 A 8/1988 Allan et al.
4,825,258 A 4/1989 Whitson
4,830,617 A 5/1989 Hancox et al.
4,860,775 A 8/1989 Reeves
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,004,423 A 4/1991 Bertrams
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,092,071 A 3/1992 Moore
5,119,576 A 6/1992 Erning
5,177,309 A 1/1993 Willoughby et al.
5,178,265 A 1/1993 Sepke
5,179,235 A 1/1993 Toole
5,194,007 A * 3/1993 Marshall ..... F41A 33/02 42/114
5,197,796 A 3/1993 Moore
5,208,826 A 5/1993 Kelly
5,179,124 A 6/1993 Schoenwald et al.
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,353,208 A 10/1994 Moore
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,488,795 A 2/1996 Sweat
D368,121 S 3/1996 Lam
5,499,455 A * 3/1996 Palmer ..... F41G 1/545 33/DIG. 21
5,509,226 A 4/1996 Houde-Walter
5,515,636 A 5/1996 McGarry et al.
5,481,819 A 6/1996 Teazel
5,531,040 A * 7/1996 Moore ..... F41G 1/35 362/114
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,605,461 A * 2/1997 Seeton ..... F41A 33/02 12/103
5,618,099 A * 4/1997 Brubacher ..... F41G 1/545 362/111
5,621,999 A * 4/1997 Moore ..... F41G 1/35 362/110
5,622,000 A 4/1997 Marlowe
5,654,594 A 8/1997 Bjornsen, III
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.

(56) References Cited

U.S. PATENT DOCUMENTS 5,716,216 A 2/1998 O'Loughlin
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,842,942 A 12/1998 Doht et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A * 6/1999 Johnsen ..... F41A 33/02 362/111
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,282,829 B1 9/2001 Mossberg et al.
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,363,648 B1 4/2002 Kranich et al.
6,366,349 B1 4/2002 Houde-Walter
6,371,004 B1 4/2002 Peterson
6,378,237 B1 4/2002 Matthews et al.
6,385,893 B1 5/2002 Cheng
6,389,729 B2 5/2002 Rauch et al.
6,389,730 B1 5/2002 Millard
6,397,509 B1 6/2002 Langner
6,421,947 B1 7/2002 Fuller
6,430,861 B1 8/2002 Ayers et al.
6,434,874 B1 8/2002 Hines
6,442,880 B1 9/2002 Allan
6,345,464 B1 12/2002 Kim et al.
6,487,807 B1 12/2002 Kopman et al.
6,499,247 B1 12/2002 Peterson
6,526,688 B1 3/2003 Danielson et al.
6,568,118 B1 5/2003 Teetzel
6,571,503 B2 6/2003 Thorpe
6,572,375 B2 * 6/2003 Shechter ..... F41A 21/26 42/114
6,575,753 B2 6/2003 Rosa et al.
6,578,311 B2 6/2003 Danielson et al.
6,579,098 B2 * 6/2003 Shechter ..... F41A 33/02 434/21
6,591,536 B2 7/2003 Houde-Walter et al.
6,606,797 B1 8/2003 Gandy
6,614,510 B1 * 9/2003 Rogers ..... G01C 3/08 356/4.01
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
6,682,350 B2 1/2004 Kehl
D487,791 S 3/2004 Freed
6,742,299 B2 6/2004 Strand
6,749,075 B2 6/2004 Bourque
6,782,789 B2 8/2004 McNulty
6,804,907 B1 10/2004 Slobodkin
6,843,478 B1 1/2005 Hoepelman
6,854,205 B2 2/2005 Wikle et al.
6,860,053 B2 3/2005 Christiansen
6,931,775 B2 8/2005 Burnett
6,935,864 B2 8/2005 Shechter et al.
6,945,782 B2 9/2005 Isoz
6,966,775 B1 11/2005 Kendir et al.
7,032,342 B2 4/2006 Pikielny
7,049,575 B2 5/2006 Hotelling
7,111,424 B1 9/2006 Moody et al.
7,117,624 B2 * 10/2006 Kim ..... F41G 11/003 42/85
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,325,352 B2 * 2/2008 Matthews ..... F41G 11/003 362/110
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
7,387,052 B2 6/2008 Chang
RE40,429 E 7/2008 Oliver et al.
7,409,770 B2 8/2008 Jones
D578,599 S 10/2008 Cheng
7,438,430 B2 10/2008 Kim
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,505,119 B2 * 3/2009 Rogers ..... F41G 3/145 356/4.01
7,578,089 B1 8/2009 Griffin
7,584,569 B2 9/2009 Kallio
7,591,098 B2 * 9/2009 Matthews ..... F41G 11/003 362/110
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 11/2010 Stokes
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.

(56) References Cited

U.S. PATENT DOCUMENTS 7,921,591 B1 4/2011 Adcock
7,926,218 B2 4/2011 Matthews et al.
7,997,023 B2 8/2011 Moore et al.
8,001,715 B2 8/2011 Stokes
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,100,694 B2 * 1/2012 Portoghese ..... F41A 33/02 434/21
8,104,220 B2 1/2012 Cobb
D653,798 S 2/2012 Janice et al.
8,109,024 B2 2/2012 Abst
8,110,760 B2 2/2012 Sharrah et al.
8,127,485 B2 3/2012 Moore
8,132,352 B2 3/2012 Lippard
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,147,304 B2 4/2012 Yamada
8,151,504 B1 4/2012 Aiston
8,151,505 B2 4/2012 Thompson
8,166,694 B2 5/2012 Swan
8,172,139 B1 5/2012 McDonald et al.
8,182,109 B2 5/2012 Matthews et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,543 B2 1/2013 Rosol et al.
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 * 6/2013 McRae ..... F41A 17/06 42/1.01
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S 1/2014 Bietsch
8,646,201 B2 2/2014 Hughes
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S 7/2014 Klecker
D710,966 S 8/2014 Barfoot
8,807,779 B1 8/2014 Izumi et al.
8,813,411 B2 8/2014 Moore et al.
8,844,189 B2 9/2014 Moore et al.
D720,423 S 12/2014 Barfoot
8,915,009 B2 12/2014 Caulk
8,919,023 B2 12/2014 Merritt et al.
8,927,083 B2 1/2015 Pell
8,938,904 B1 1/2015 Sellers et al.
D722,125 S 2/2015 Zayatz
8,944,626 B2 2/2015 Matthews et al.
8,944,838 B2 2/2015 Mulfinger
8,991,093 B1 3/2015 Calvert
9,011,279 B2 4/2015 Johnson et al.
9,023,459 B2 5/2015 Hogue
9,146,077 B2 9/2015 Moore
9,182,194 B2 11/2015 Moore
9,188,407 B2 11/2015 Moore
9,243,865 B1 1/2016 Bruhns
9,272,402 B2 3/2016 Hu
9,297,614 B2 3/2016 Moore
9,453,702 B2 9/2016 Bruhns
9,644,826 B2 5/2017 Moore
9,658,031 B1 5/2017 Hedeen
9,772,163 B2 9/2017 Sharrah et al.
9,777,984 B1 10/2017 Bovine
9,791,240 B2 10/2017 Bruhns
D802,704 S 11/2017 Planck
9,810,411 B2 11/2017 Galli
9,829,280 B1 11/2017 Moore et al.
9,841,254 B2 12/2017 Moore
9,915,508 B2 3/2018 Moore et al.
9,982,963 B2 5/2018 Johnson
10,113,836 B2 10/2018 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0104249 A1 8/2002 Lin
2002/0129536 A1 * 9/2002 Iafrate ..... F41A 33/02 42/134
2002/0134000 A1 * 9/2002 Varshneya ..... F41A 33/02 42/115
2002/0148153 A1 10/2002 Thorpe
2002/0194767 A1 * 12/2002 Houde-Walter ..... F41G 1/35 42/114
2003/0003424 A1 * 1/2003 Shechter ..... F41A 33/02 434/21
2003/0022135 A1 1/2003 Shechter et al.
2003/0029072 A1 * 2/2003 Danielson ..... F41G 1/35 42/114
2003/0084601 A1 5/2003 Kunimoto
2003/0175661 A1 9/2003 Shechter et al.
2003/0180692 A1 * 9/2003 Skala ..... F41G 1/35 434/22
2003/0196366 A1 * 10/2003 Beretta ..... F41C 23/18 42/71.01

(56) References Cited

U.S. PATENT DOCUMENTS

2004/0003529 A1* 1/2004 Danielson ..... F41C 23/00 42/114
2004/0010956 A1* 1/2004 Bubits ..... F41G 1/01 42/144
2004/0014010 A1* 1/2004 Swensen ..... F41A 33/02 434/21
2004/0064994 A1 4/2004 Luke
2005/0044736 A1* 3/2005 Liao ..... G01C 15/008 33/286
2005/0130739 A1* 6/2005 Argentar ..... A63F 13/02 463/36
2005/0153262 A1* 7/2005 Kendir ..... F41G 3/2655 434/21
2005/0185403 A1* 8/2005 Diehl ..... F41H 13/0056 362/259
2005/0188588 A1* 9/2005 Keng ..... F41A 23/10 42/72
2005/0241209 A1* 11/2005 Staley, III ..... F41G 1/48 42/111
2005/0257415 A1* 11/2005 Solinsky ..... F41G 11/003 42/146
2005/0268519 A1* 12/2005 Pikielny ..... F41G 1/35 42/124
2006/0162225 A1* 7/2006 Danielson ..... F41C 23/10 42/117
2006/0191183 A1* 8/2006 Griffin ..... F41C 23/16 42/72
2007/0039226 A1 2/2007 Stokes
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0227298 A1 9/2010 Charles
2010/0229448 A1 9/2010 Houde-Walter
2010/0263254 A1 10/2010 Glock
2010/0275496 A1 11/2010 Solinsky et al.
2011/0047850 A1 3/2011 Rievley et al.
2011/0061283 A1 3/2011 Cavallo
2011/0074303 A1 3/2011 Stokes
2011/0119868 A1 5/2011 LaLonde
2011/0154712 A1 6/2011 Moore
2011/0162249 A1 7/2011 Woodmansee et al.
2011/0162251 A1 7/2011 Houde-Walter
2011/0185619 A1 8/2011 Finnegan et al.
2011/0225867 A1 9/2011 Moore
2012/0005938 A1 1/2012 Sloan
2012/0047787 A1 3/2012 Curry
2012/0055061 A1 3/2012 Hartley et al.
2012/0110886 A1 5/2012 Moore et al.
2012/0124885 A1 5/2012 Caulk et al.
2012/0129136 A1 5/2012 Dvorak
2012/0144716 A1 6/2012 Cabahug et al.
2012/0144718 A1 6/2012 Danielson
2012/0180366 A1 7/2012 Jaroh et al.
2012/0180367 A1 7/2012 Singh
2012/0180370 A1 7/2012 McKinley
2012/0224357 A1 9/2012 Moore
2012/0224387 A1 9/2012 Moore
2012/0268920 A1 10/2012 Matthews
2013/0185978 A1 7/2013 Dodd et al.
2013/0185982 A1 7/2013 Hilbourne et al.
2013/0205635 A1 8/2013 Hines
2013/0263492 A1 10/2013 Erdle
2013/0318851 A1 12/2013 Diamond
2014/0007485 A1 1/2014 Castejon
2014/0109457 A1 4/2014 Speroni
2014/0157645 A1 6/2014 Moore
2014/0176463 A1 6/2014 Donahoe
2014/0256481 A1 9/2014 Flint
2014/0355258 A1 12/2014 Izumi et al.
2015/0192391 A1 7/2015 Moore
2015/0226508 A1 8/2015 Hughes
2015/0233668 A1 8/2015 Moore
2015/0283459 A1 10/2015 Condon
2015/0308670 A1 10/2015 Moore
2015/0345905 A1 12/2015 Hancosky
2015/0348330 A1 12/2015 Balachandreswaran
2016/0059136 A1 3/2016 Ferris
2016/0084618 A1 3/2016 Hong
2016/0091285 A1 3/2016 Mason
2016/0161220 A1* 6/2016 Moore ..... F41G 3/2655 42/117
2016/0169608 A1 6/2016 Schulz
2016/0195366 A1 7/2016 Kowalczyk et al.
2016/0209170 A1 7/2016 Mock et al.
2016/0209174 A1 7/2016 Hartley et al.
2016/0245617 A1 8/2016 Moore
2016/0305748 A1 10/2016 Moore
2016/0361626 A1 12/2016 Moore
2017/0003103 A1 1/2017 Moore
2017/0030677 A1 2/2017 Faifer
2017/0082399 A1 3/2017 Moore
2017/0153095 A1 6/2017 Moore
2017/0160054 A1 6/2017 Moore
2017/0205182 A1 7/2017 Hughes et al.
2018/0023923 A1 1/2018 Uhr
2018/0058804 A1 3/2018 Moore
2018/0135944 A1 5/2018 Moore
2018/0149443 A1 5/2018 Dottle

OTHER PUBLICATIONS

EPO; Office Action dated Oct. 5, 2011 in Serial No. 09169459.
EPO; Office Action dated Oct. 5, 2011 in Serial No. 09169469.
EPO; Office Action dated Dec. 20, 2011 in Application No. 09169476.
Epo; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 0969469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.

(56) References Cited

OTHER PUBLICATIONS

USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Notice of Allowance dated Jun. 5, 2015 in U.S. Appl. No. 13/353,165.
USPTO; Notice of Allowance dated Jul. 24, 2015 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014 in U.S. Appl. No. 13/707,312.
USPTO; Notice of Allowance dated Jun. 11, 2014 in U.S. Appl. No. 13/707,312.
USPTO; Notice of Allowance dated Jul. 7, 2015 in U.S. Appl. No. 14/182,140.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Notice of Allowance dated Jun. 24, 2015 in U.S. Appl. No. 14/316,688.
USPTO; Office Action dated Mar. 3, 2015 in U.S. Appl. No. 14/278,315.
USPTO; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Jul. 2, 2015 in U.S. Appl. No. 14/459,274.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.
USPTO; Office Action dated Feb. 24, 2017 in U.S. Appl. No. 15/166,145.
USPTO; Notice of Allowance dated Mar. 7, 2017 in U.S. Appl. No. 14/630,467.
UPSTO; Notice of Allowance and Fees Due dated Jul. 11, 2017 in U.S. Appl. No. 15/130,744.
USPTO; Notice of Allowance and Fees Due dated Jul. 31, 2017 in U.S. Appl. No. 15/166,145.
USPTO; Non-Final Office Action dated Aug. 24, 2017 in U.S. Appl. No. 15/253,543.
USPTO; Supplemental Notice of Allowance dated Sep. 13, 2017 in U.S. Appl. No. 15/166,145.

(56) References Cited

OTHER PUBLICATIONS

USPTO; Final Office Action dated Sep. 28, 2017 in U.S. Appl. No. 15/243,813.
USPTO; Notice of Allowance dated Oct. 27, 2017 in U.S. Appl. No. 14/955,440.
USPTO; Notice of Allowance dated Nov. 13, 2017 in U.S. Appl. No. 14/955,440.
USPTO; Final Office Action dated May 18, 2017 in U.S. Appl. No. 15/243,813.
USPTO; Requirement for Restriction dated Jun. 5, 2017 in U.S. Appl. No. 14/863,304.
USPTO; Non-Final Office Action dated Aug. 30, 2016 in U.S. Appl. No. 14/955,440.
UPSTO; Non-Final Office Action dated Oct. 6, 2016 in U.S. Appl. No. 15/243,813.
USPTO; Notice of Allowance dated Apr. 26, 2017 in U.S. Appl. No. 15/130,744.
USPTO; Non-Final Office Action dated Dec. 7, 2017 in U.S. Appl. No. 15/075,769.
USPTO; Non-Final Office Action dated Dec. 18, 2017 in U.S. Appl. No. 15/787,134.
USPTO; Final Office Action dated Feb. 7, 2018 in U.S. Appl. No. 15/253,543.
USPTO; Non-Final Office Action dated Feb. 8, 2018 in U.S. Appl. No. 14/863,304.
USPTO; Non-Final Office Action dated Feb. 26, 2018 in U.S. Appl. No. 15/804,229.
USPTO; Requirement for Restriction dated Jun. 11, 2018 in U.S. Appl. No. 15/181,279.
USPTO; Advisory Action dated Jun. 14, 2018 in U.S. Appl. No. 15/253,543.
USPTO; Notice of Allowance dated Jun. 20, 2018 in U.S. Appl. No. 15/787,134.
USPTO; Non-Final Office Action dated Jun. 29, 2018 in U.S. Appl. No. 15/600,571.
USPTO; Notice of Allowance dated Jul. 18, 2018 in U.S. Appl. No. 15/075,769.
USPTO; Non-Final Office Action dated Jul. 20, 2018 in U.S. Appl. No. 15/253,543.
Google Search for crossbow laser, image search conducted on Nov. 29, 2017, 14 pages.
Google Search for crossbow laser, image search conducted on Nov. 29, 2017, 2 pages.
CrossbowNation-Community-Gear Review, Crossbow Laser Boresighter Bolt Video Review, 1 page, printed on Nov. 29, 2017, dated Apr. 18, 2010.
CrossbowNation, Gear Review, Crossbow Laser Boresighter Bolt Video Review, 6 images taken therefrom, 6 pages, printed on Nov. 29, 2017, dated Apr. 18, 2010.
Ducet, "Arsenal Strike One Review," http://dennyducet.blogspot.com/2015/06/the-arsenal-strike-one-innovative.html, (Jun. 18, 2015).
USPTO; Final Office Action dated Aug. 31, 2018 in U.S. Appl. No. 15/804,229.
USPTO; Notice of Allowance dated Aug. 31, 2018 in U.S. Appl. No. 15/075,769.
USPTO; Non-Final Office Action dated Sep. 19, 2018 in U.S. Appl. No. 15/243,813.
USPTO; Notice of Allowance dated Oct. 3, 2018 in U.S. Appl. No. 15/884,122.

* cited by examiner

MASTER MODULE LIGHT SOURCE AND TRAINER

CROSS REFERENCE TO RELATED APPLICATIONS

This application is a continuation in part of, and claims priority to U.S. application Ser. No. 14/459,274 entitled "MASTER MODULE LIGHT SOURCE, RETAINER AND KITS" filed on Aug. 13, 2014.

BACKGROUND OF THE INVENTION

There are many known devices used as laser sighters for weapons, particularly pistols. It has, however, been difficult to develop a suitable laser sighter for small pistols (such as those that fit into one's pocket) because there is very little available space on the side or top of the gun to mount a laser, and mounting it to a trigger guard can be difficult plus the laser can be jarred out of position. Moreover, mounting a laser in any of the above positions on a small pistol may make the assembled pistol and laser hard to conceal, or fit within a pocketbook or pocket, which defeats its purpose.

Therefore, for these applications the laser has typically been mounted in a casing (preferably made of plastic) positioned in front of the trigger guard in order to minimize the additional size of the assembled device. The problem, however, is that for virtually every make and model of gun, a different laser assembly configuration is required because of the different gun configuration. Hence, a manufacturer may require to manufacture and inventory, and dealers may have to inventory, dozens (or more) of different laser assembly/casing units to fit each type of small pistol. This increases manufacturing and inventory carrying costs. Plus, there is a greater possibility that the manufacturer or dealer will have too much of one type of laser assembly/casing unit and not enough of another.

Additionally, there are laser sights used with a gun when firing bullets, and laser trainers, used with a gun when, instead of firing a bullet, when the firing pin is activated, a laser light beam is generated.

SUMMARY OF THE INVENTION

The present invention solves these and other problems by making one universal laser unit (also called a "master module") that incorporates a laser, a power source (such as one or more batteries), a control unit that controls the operation of the laser (which has one or more switches), and a laser adjustment mechanism, into one, fully-assembled, compact unit that can fit into any casing designed for virtually every type of small pistol. With this single laser unit (also called a "combination unit" or "unit"), a manufacturer and dealer only need to stock this single unit. Further, this unit is preferably attached using a single fastener to a casing that fits on a small pistol. In summary, a unit according to the invention greatly reduces assembly, manufacturing and inventory time and expense for the manufacturer, inventory expense for the dealer, and makes assembly easy for an end user (which is often the gun owner).

An example of the laser unit is shown in the appended drawings and some specific examples of the invention are set forth herein. In a preferred embodiment, a two-piece laser unit casing (preferably made of hard plastic), also called a combination unit casing, unit casing or casing, is provided. A fully-assembled laser unit according to the invention is attached to one side of the casing, preferably by a single fastener, so mounting it is easy. The laser unit preferably is received in a cavity in the casing where it is supported and subject to limited shock and movement.

After the laser unit is attached to one side of the casing, the entire casing is assembled to a pistol. This is done in a manner known to those skilled in the art. The two pieces of the casing are pressed together and have a recess that receives the front part of the trigger guard. Once pressed together, the laser unit is held snuggly in a cavity formed inside of the casing pieces, and the two pieces of the casing are fastened tightly together, such as by using two threaded fasteners with corresponding nuts. This pulls the two pieces of the casing together tightly on the front of the trigger guard, and the pieces also form a groove that mates against the bottom of the gun barrel in front of the trigger guard to help make a snug fit.

Once fully assembled onto a gun, the casing has an aperture for laser light to emanate out from the laser unit, two other openings to allow access to laser adjustment fasteners (one to adjust the laser in the up-and-down directions and the other to adjust it side to side), and an opening to provide access to a battery cap to allow the battery(ies) or other power source to be changed without opening the casing.

A laser unit according to the invention could be, for example, sold separately (with the casings also sold separately), could be sold assembled into a casing, or could be sold as a kit with multiple casings that fit multiple, different pistols.

In another aspect of the invention, a device incorporates a light source, a power source, and a control unit. The device has two operating modes and a switch to select between the two modes. In a first operating mode the light source has a first control function wherein it emits light and a second control function wherein it does not emit light. In a second mode the light source emits light when the sound of a gun firing pin is detected. This embodiment is not limited to any particular module structure, although the preferred structure is the master module described herein.

DETAILED DESCRIPTION OF PREFERRED EMBODIMENTS

Figure 1:
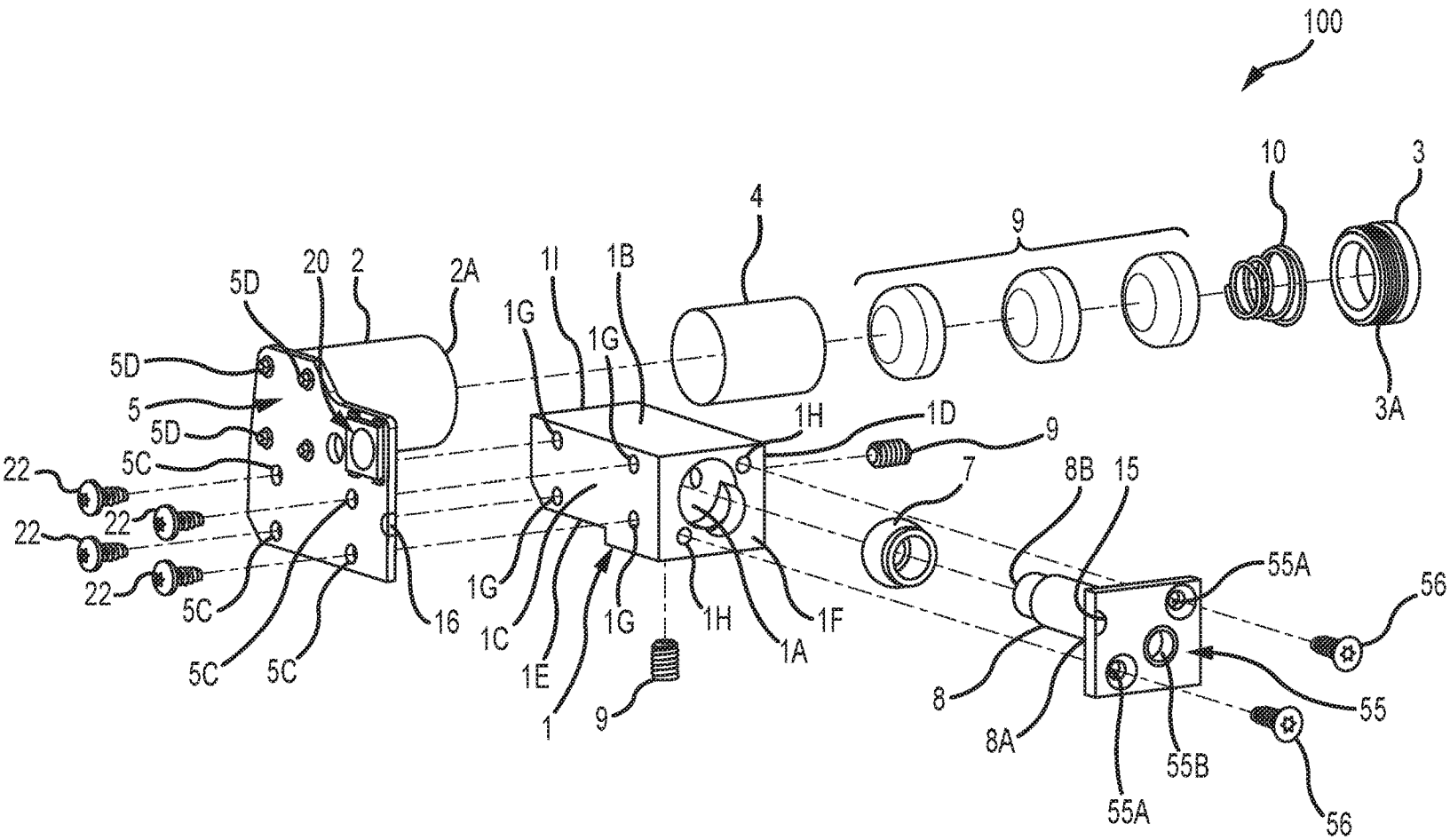
FIG. 1 is an exploded view of a master module according to aspects of the invention.
Figure 2C:
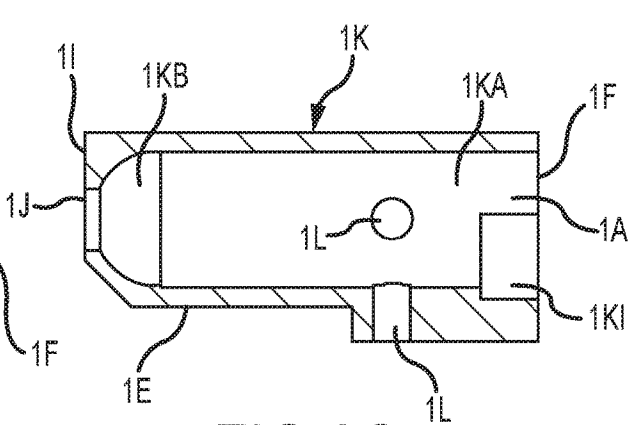
FIGS. 2A-2F are views of a housing used in the master module of FIG. 1.
Figure 2B:
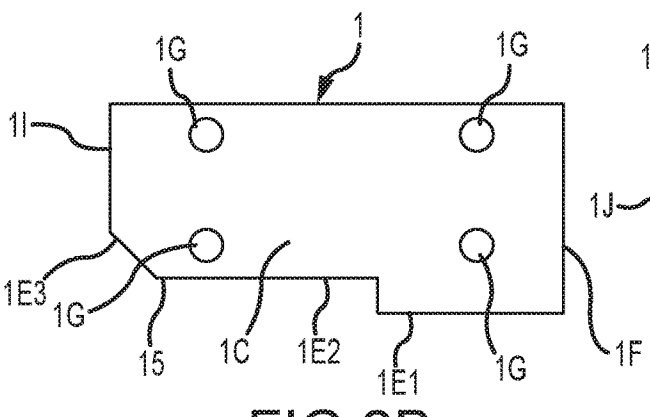
Figure 2A:
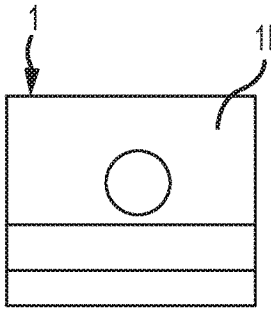
Figure 2F:
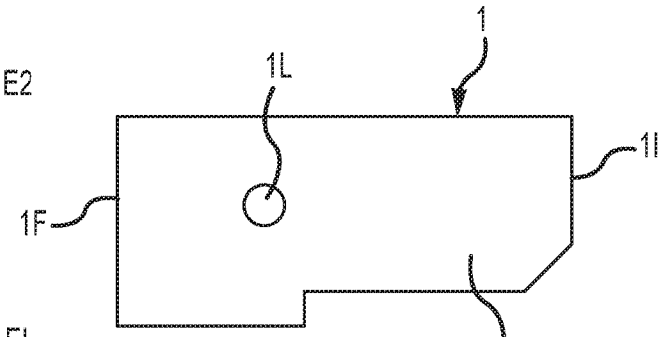
Figure 2E:
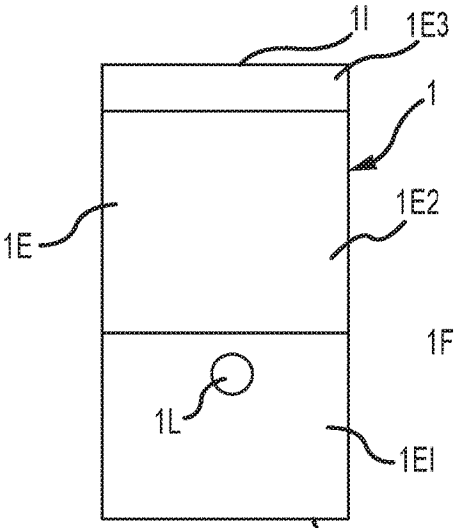
Figure 2D:
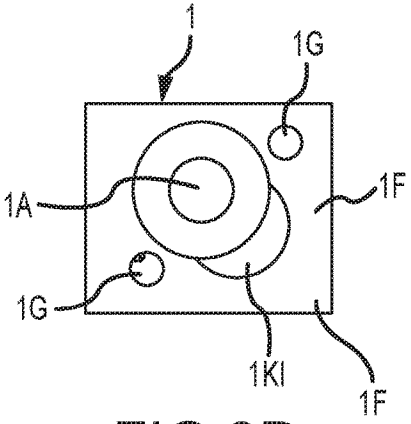

Turning now to the drawings where the purpose is to describe preferred embodiments of the invention and not to limit same, FIG. 1 shows an exploded view of a laser module (also called a combined unit, or master module) 100. Combined unit 100 is configured to be compact and to provide a laser sighter for various types of small pistols. Combined unit 100 can reduce manufacturing and inventory costs because it can be used in place of multiple laser modules, each having different configurations.

Combined unit 100 has a laser module housing 1. Housing 1 is preferably made of metal, such as aluminum, or plastic, such as an electrically conductive plastic. Any suitable material, however, may be used to form laser module housing 1. Laser module housing 1 has a cavity 1A for receiving a module cushion ball 7 and laser module 8. Laser module housing has a top 1B, a first side 1C, a second side 1D, a bottom 1E (with portions 1E1, 1E2 and 1E3), a front 1F, and a back 11. Side 1C has apertures 1G for mounting housing 1 to module mount board 5.

The bottom 1E of laser module 1E is stepped with a first part 1E1, a second part 1E2 and an angled end 1E3 that connects to side 11. Side 11 has an opening 1M through which laser light 1M through which laser light can be emitted.

Opening 1A leads to a cavity 1K that has a first portion 1KA and a second portion 1KB that retains module cushion ball 7. Bottom portion 1E1 includes an opening 1L that receives a set screw 9. Side 1D also includes an opening 1L that accepts a set screw 9. Side 1D also includes an opening 1L that accepts a set screw 9. When laser module 8 and cushion ball 7 are positioned in cavity 1K, set screws 9 can be tightened or loosened to reposition laser module 8 in cavity 1K.

Laser module 8 has a first end 8A that connects to PCB 55 in communication with opening 55B and a second end 8B that includes a lens through which laser light is emitted.

Module mount board 5 serves the purpose of being structural and including circuitry that directs power from power source 9 though circuit board 55 to laser module 8. Module mount board 5 has a rear side 5A and a front side 5B. A tactile dome switch 20 is attached to module mount board 5. Switch 20 has a compressive portion 20A (as shown it is on both sides 5A and 5B) that, when compressed, activates the circuitry to transfer power from power source 9 to laser module 8. When pressure is released from switch 20 preferably power is no longer transferred to laser module 8.

Module mount board 5 also includes openings 5C that align with openings 1G. Screws 22 are then positioned through openings 5C and received in openings 1G to retain module housing 1 to module mount board 5, and circuit board 55 is pressed into communication with the circuitry on module mount board 5 by contact 16 being in contact with contact 1G.

Battery casing 2 is tubular and hollow to receive insulating sleeve 4 and power source 9, which is shown is three batteries preferably of type 3V photo cell batteries. Sleeve 4 is positioned in the opening of battery casing 2 and batteries 9 are positioned inside of sleeve 4. Biasing spring 10 is positioned between batteries 9 and battery cap 3. Battery cap 3 has a threaded end 3A that is received in a threaded portion of the inner wall of battery casing 2, and an outer surface 3B with a slot 3D for being turned by a screwdriver.

Figure 3A:
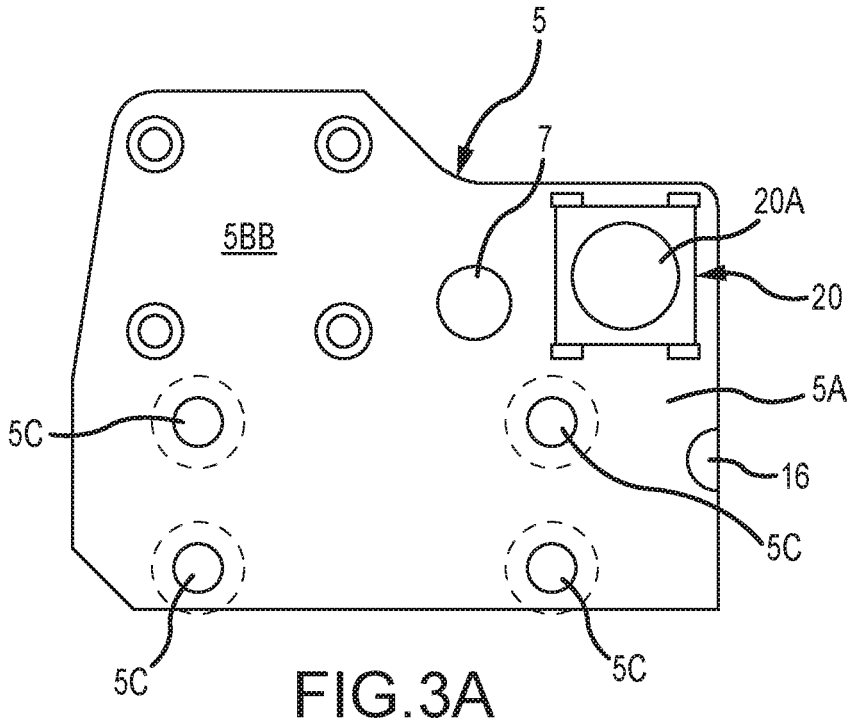
FIGS. 3A-3B are back and front views of a module mount board used in the master module of FIG. 1.
Figure 3B:
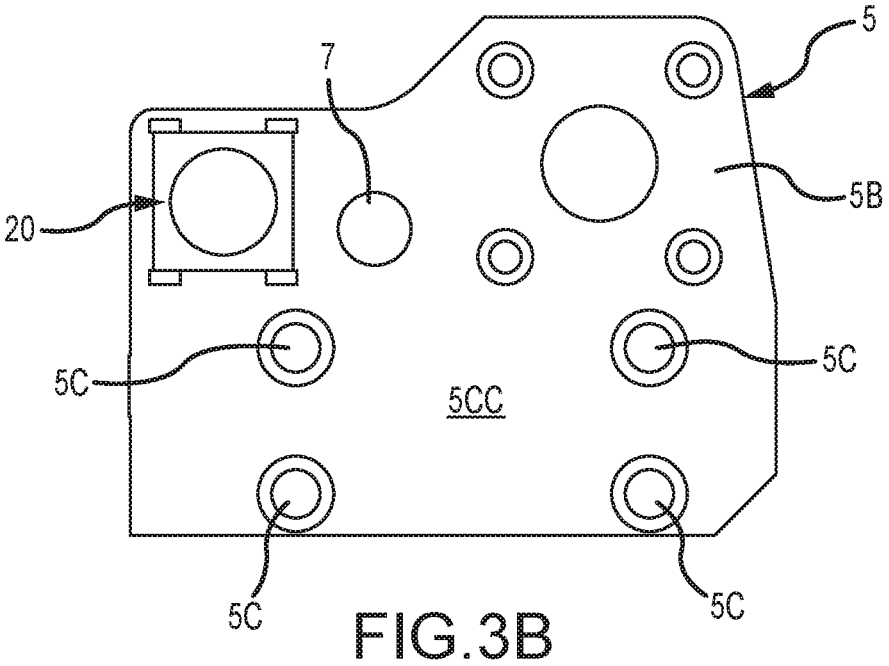
Figure 6:
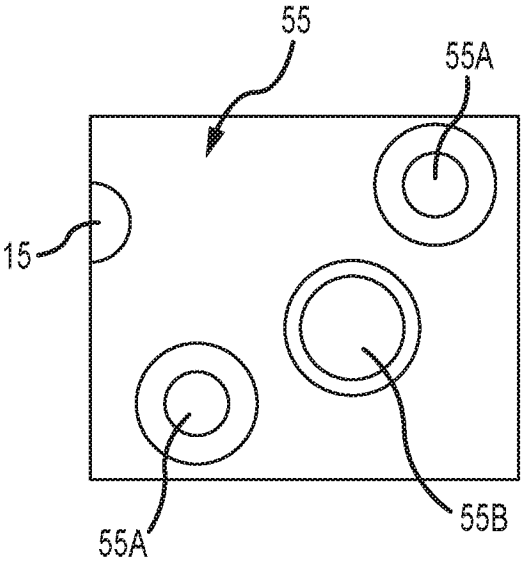
FIG. 6 is a front view of the circuit board used in the master module of FIG. 1.
Figure 5:
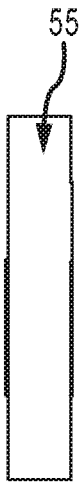
FIG. 5 is a side view of the circuit board used in the master module of FIG. 1.
Figure 4:
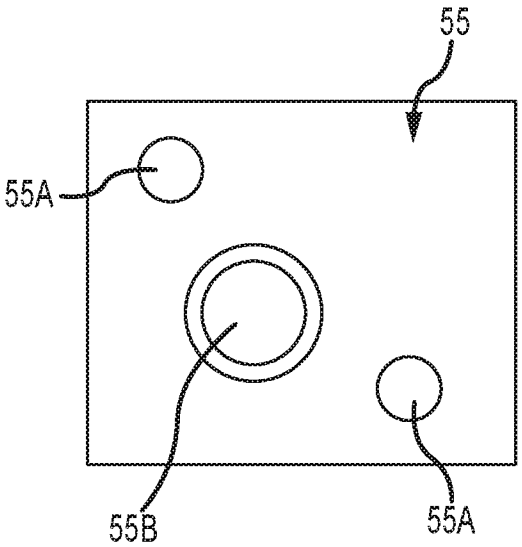
FIG. 4 is a back view of a circuit board used in the master module of FIG. 1.
Figure 8:
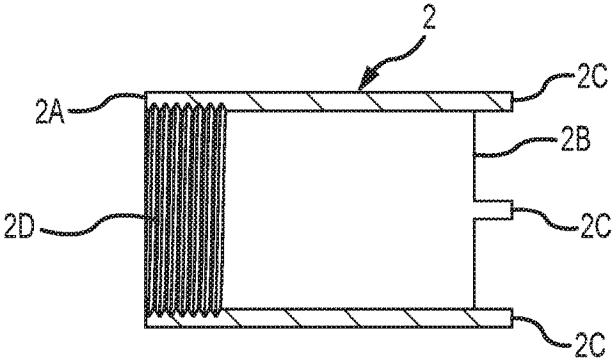
FIG. 8 is a cross-sectional, side view of a battery casing used in the master module of FIG. 1 showing internal threads.
Figure 10:
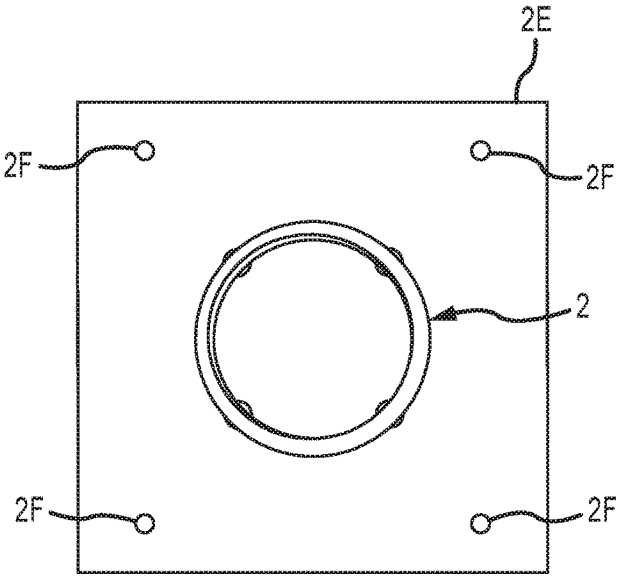
FIG. 10 is a rear view of a battery casing used in the master module of FIG. 1 with the battery casing attached to a connection plate.

FIGS. 2A-2F show various views of housing 1. FIGS. 3A and 3B show, respectively, the back surface 5BB and front surface 5CC of module mount board 5. Opening 7 is for receiving a fastener to connect combined unit 100 to a casing that mounts on a gun. FIGS. 4-6 show, respectively a back view, side view, and front view of circuit board 55.

Figure 7:
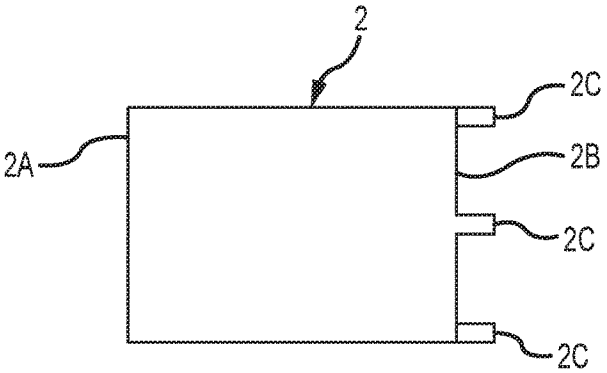
FIG. 7 is a side view of a battery casing used in the master module of FIG. 1.
Figure 9:
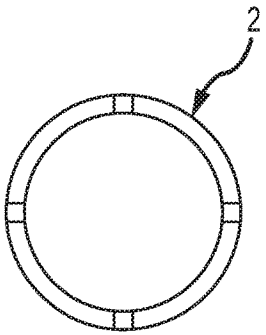
FIG. 9 is a front view of a battery casing used in the master module of FIG. 1.

FIG. 7 is a side view of battery casing 2 with a front end 2A through which insulation sleeve 4 and batteries 9 are inserted. Back end 2B includes a multiple (and preferably four) stems 2C to attach casing 2 to plate 2E, which is attached to module mount 5 utilizing openings 2F to be attached utilizing fasteners 5D. Threads 2D align with and receive threads 3A on cap 3.

Figure 13:
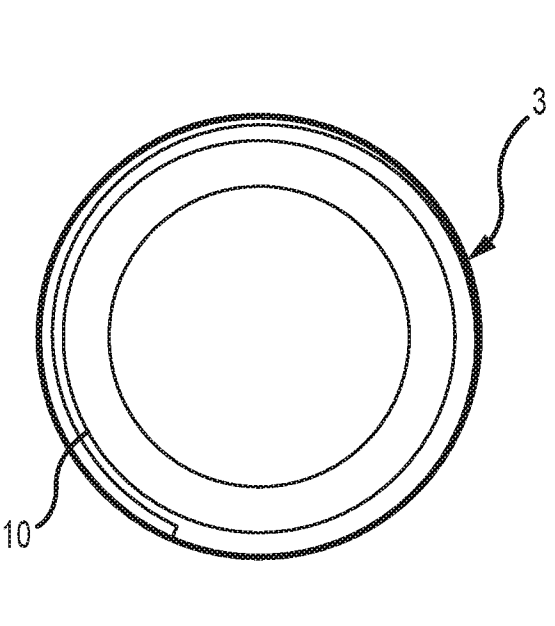
FIG. 13 is a front view of a battery cap used in the master module of FIG. 1.
Figure 12:
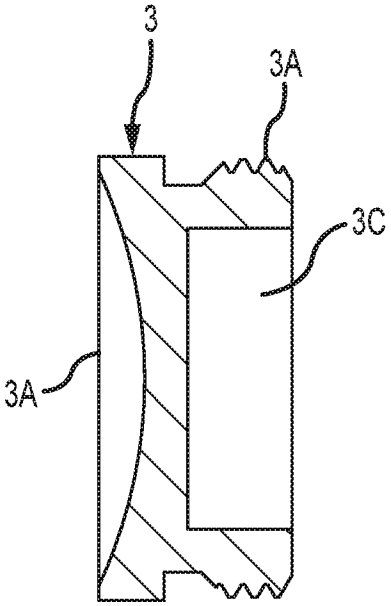
FIG. 12 is a side, cross-sectional view of a battery cap used in the master module of FIG. 1.
Figure 11:
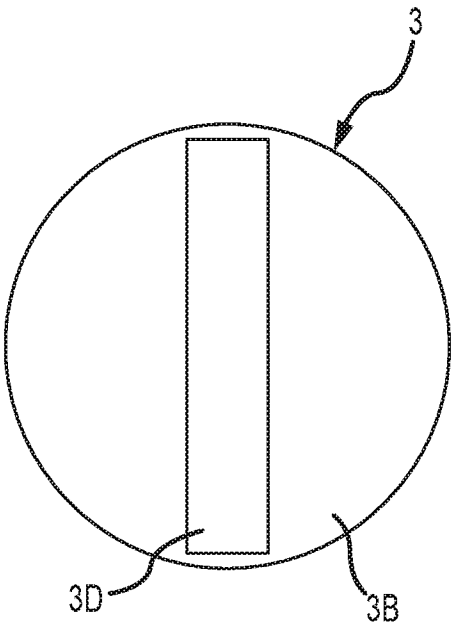
FIG. 11 is a rear view of a battery cap used in the master module of FIG. 1.
Figure 14:
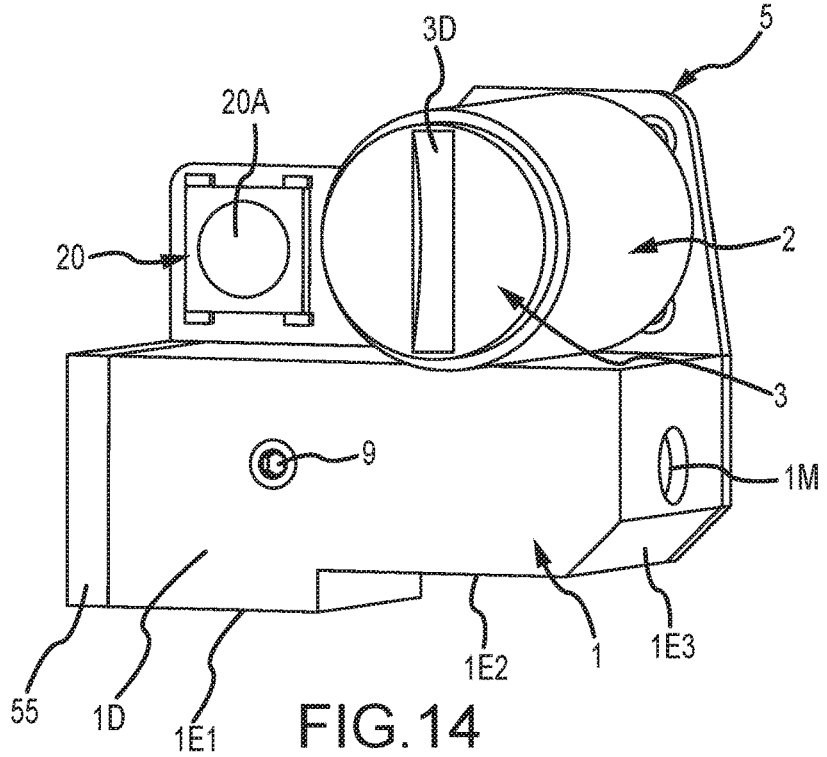
FIG. 14 shows a perspective, side view of a fully assembled master module according to aspects of the invention.
Figure 15:
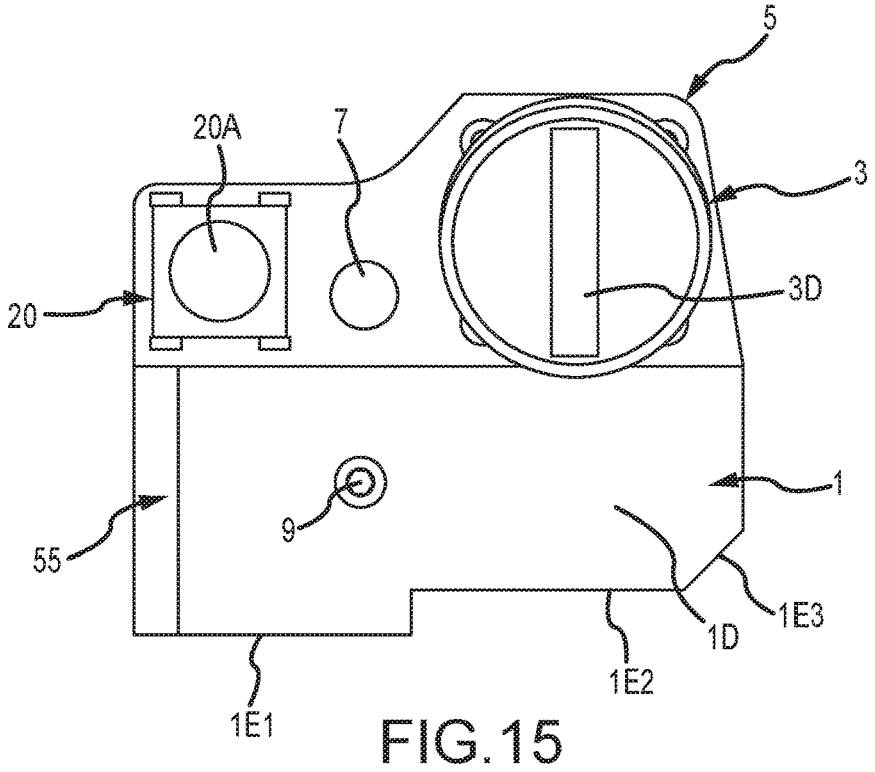
FIG. 15 is a front view of the master module of FIG. 14.
Figure 16:
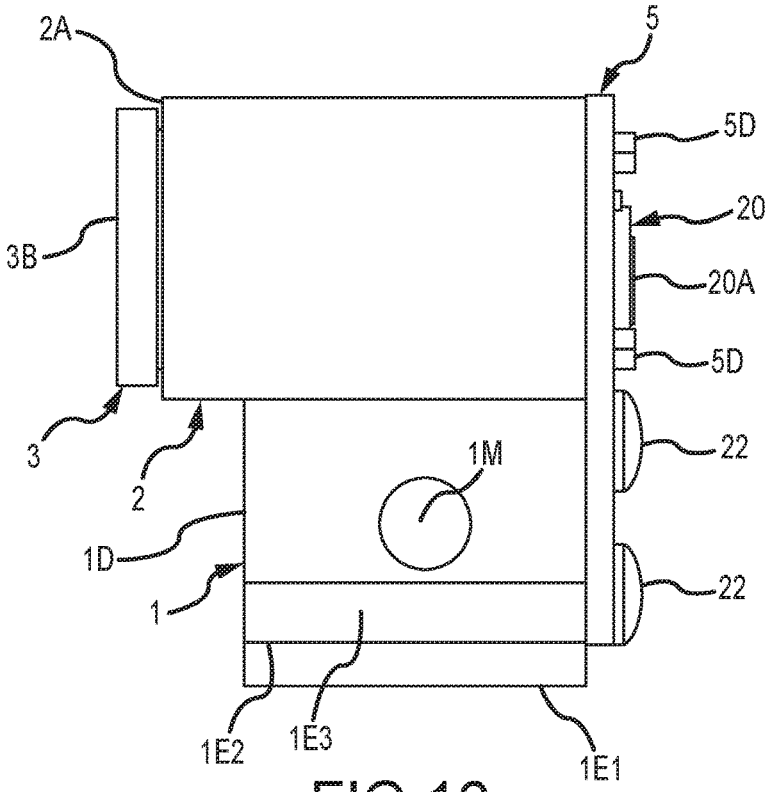
FIG. 16 is a side view of the master module of FIG. 14.
Figure 17:
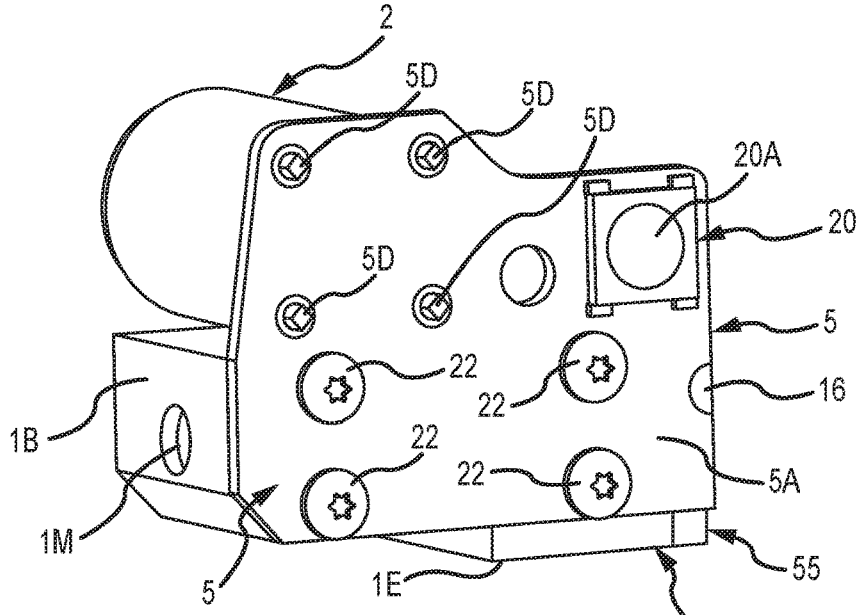
FIG. 17 is a back, perspective view of the master module of FIG. 14.
Figure 18:
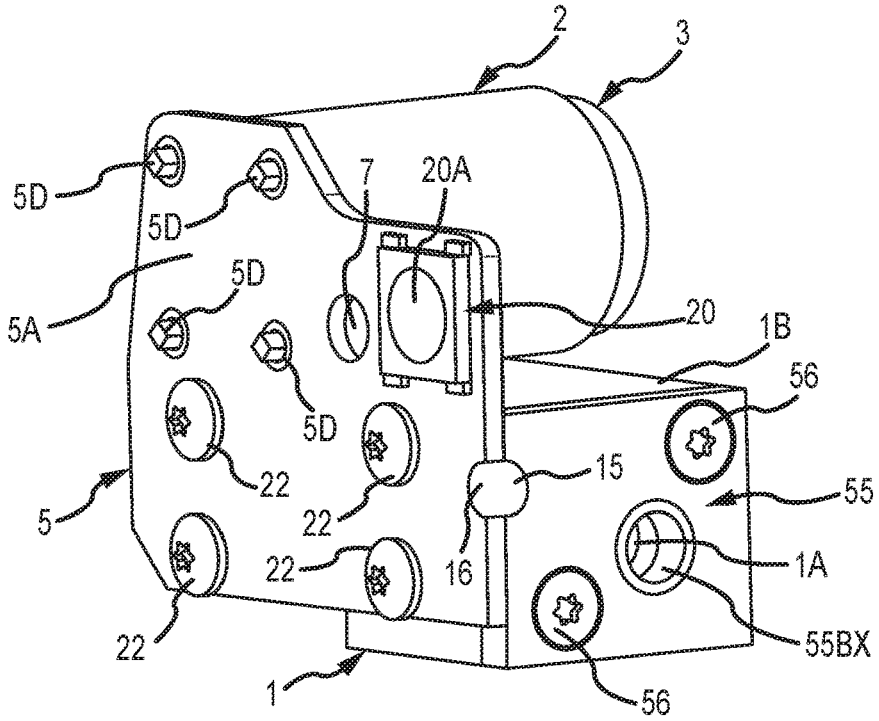
FIG. 18 is an opposite back, perspective view of the master module of FIG. 14.
Figure 19:
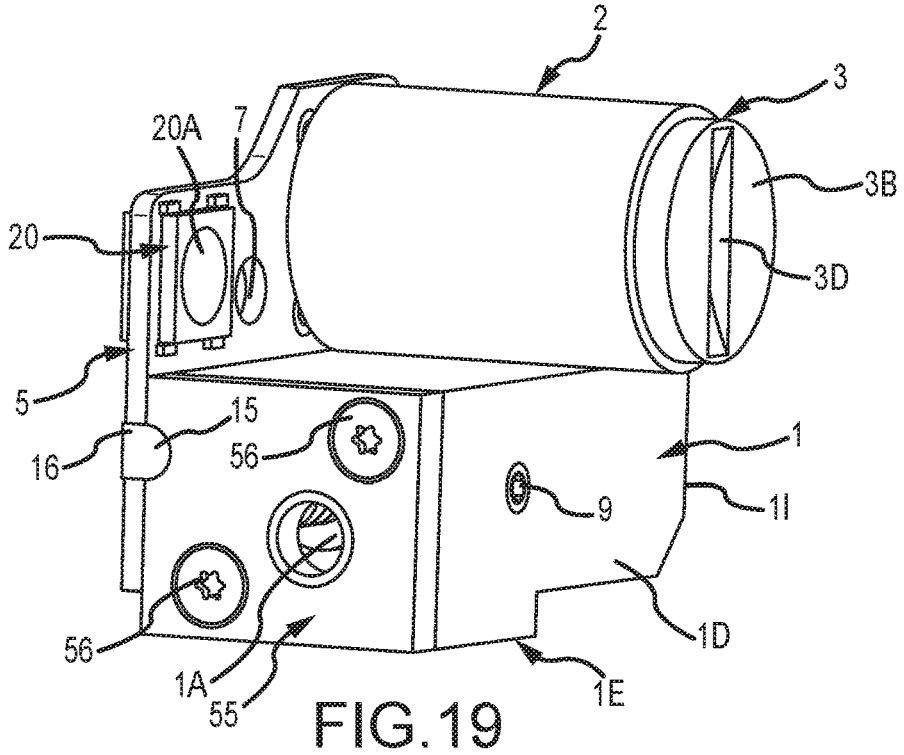
FIG. 19 is a side, perspective view of the master module of FIG. 14.
Figure 20:
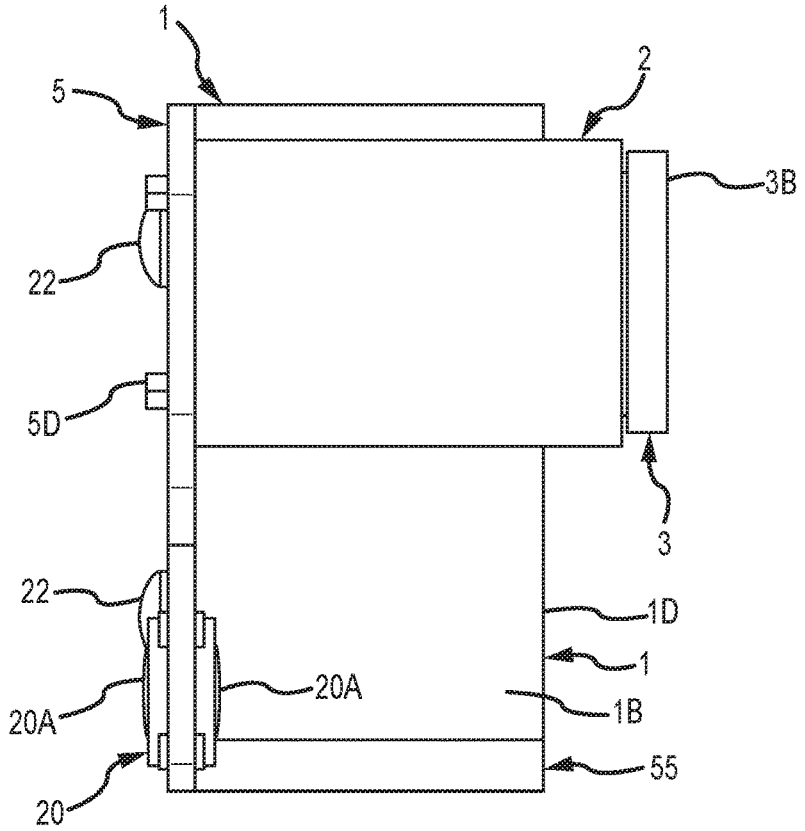
FIG. 20 is a top view of the master module of FIG. 14.
Figure 21:
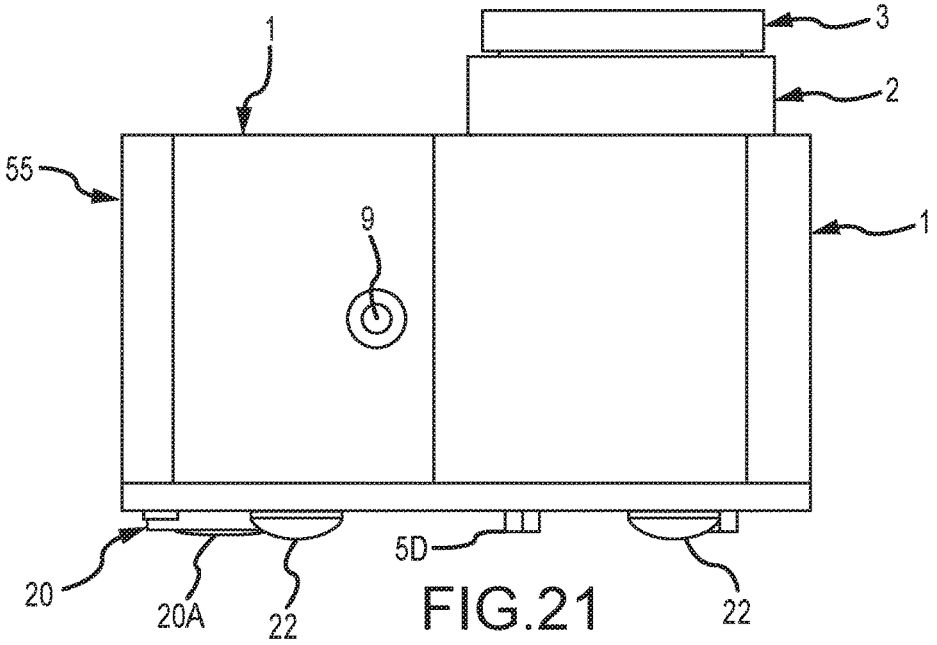
FIG. 21 is a bottom view of the master module of FIG. 14.
Figure 22:
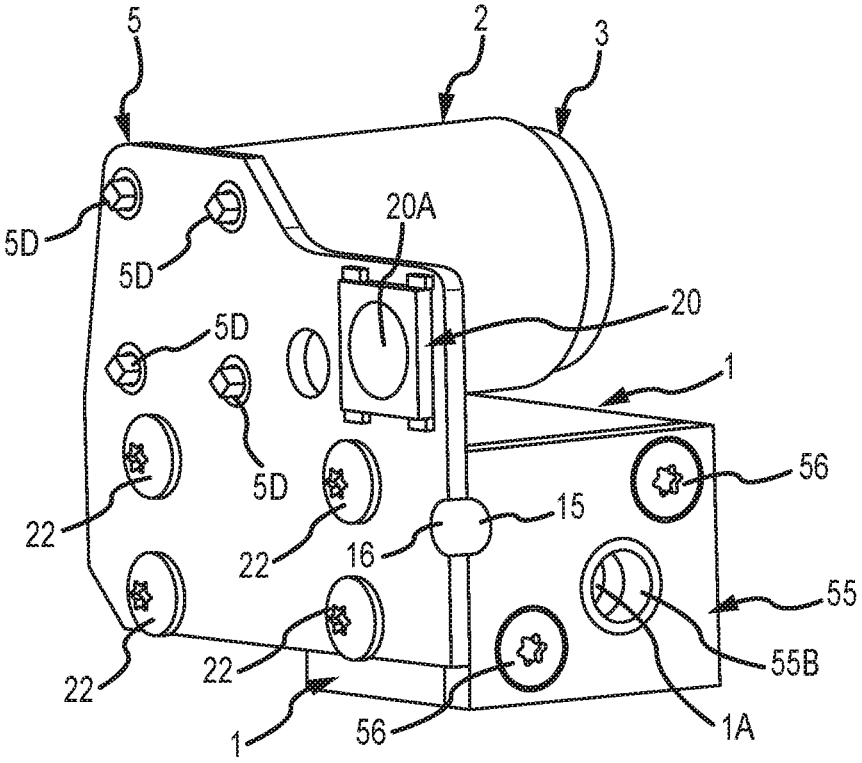
FIG. 22 is another back, perspective view of the master module of FIG. 14.

FIGS. 11-13 depict cap 3. FIG. 11 is a rear view, FIG. 12 is a cross-sectional side view, and FIG. 13 is a front view with spring 10 pressed into cavity 3C.

FIGS. 14-22 show a fully assembled master module according to aspects of the invention.

Figure 23:
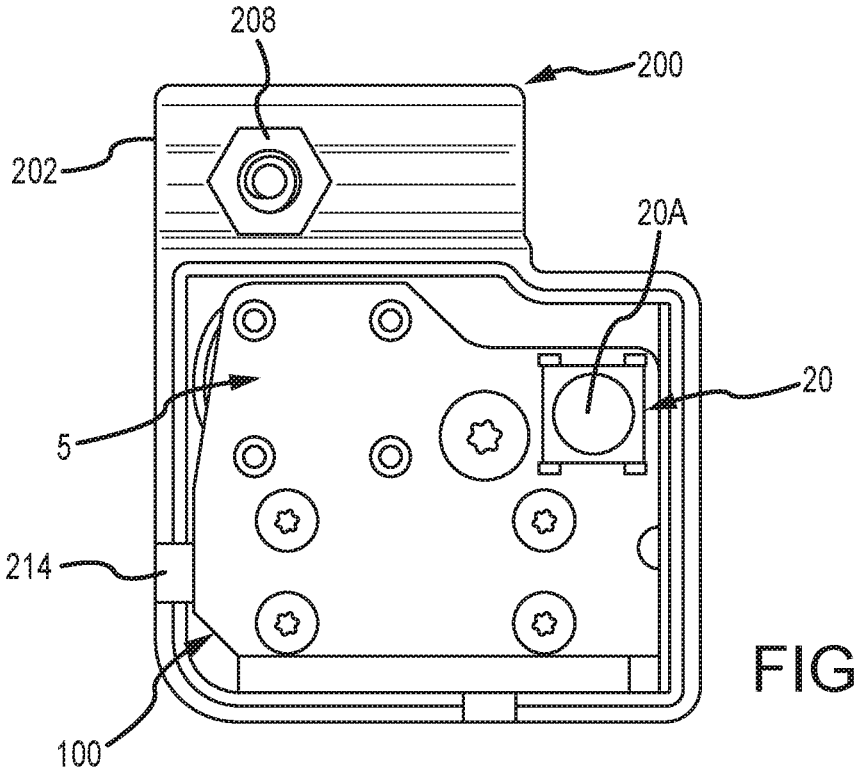
FIG. 23 shows a master module according to aspects of the invention mounted in a casing that can be mounted to a picatinny rail of a gun.
Figure 24:
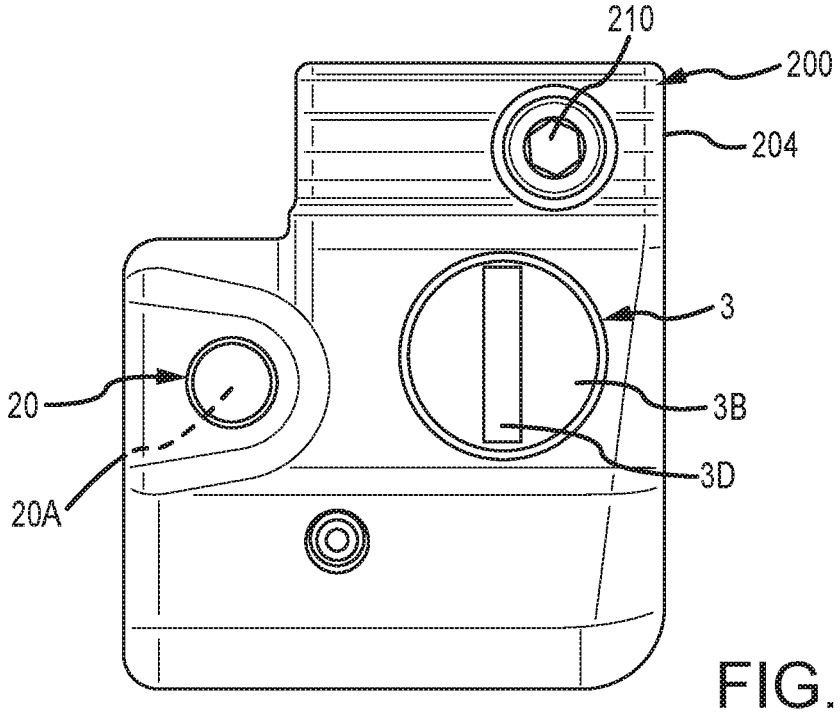
FIG. 24 shows the opposite side of the structure of FIG. 23.
Figure 25:
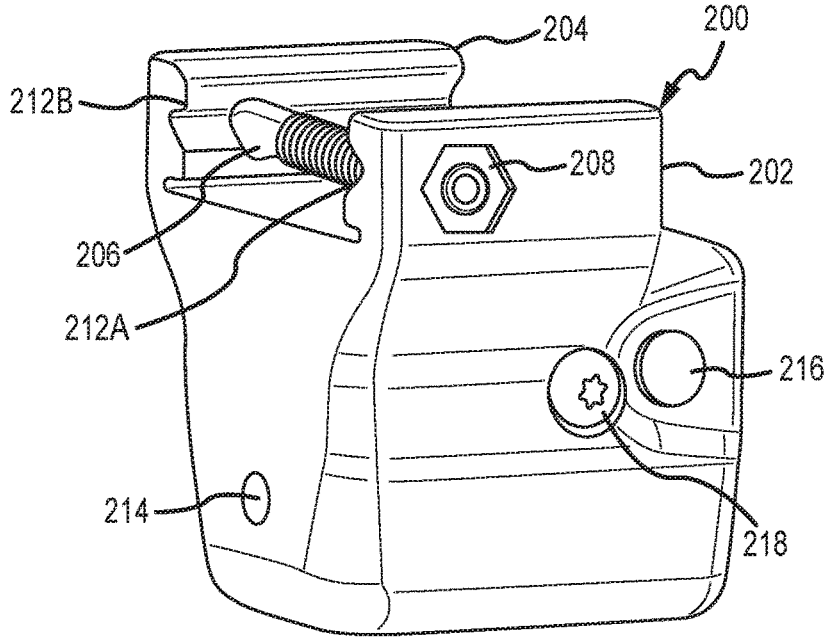
FIG. 25 shows a front, perspective view of the structure of FIGS. 23-24.

FIGS. 23 and 24 show the fully assembled master module according to FIGS. 14-22 positioned in a casing 200 that can be mounted on picatinny rail of a pistol. FIG. 25 shows a perspective view of casing 200.

FIG. 23 shows a combined unit 100 positioned in a casing 200 that has a top portion configured to mount on the picatinny rail of a gun. In this view the casing 200 is open to show combined unit 100 therein. FIG. 24 shows the opposite side of the casing 200 with the casing closed. Fastener 208 is used to close the top portion snuggly on a picatinny rail. 214 is an opening in canister 200 through which laser light can be emitted. FIG. 25 shows canister 200 in a side, perspective view. Rail 202, with groove 212A and rail 204, with groove 212B, can be tightened (using bolt 206 and nut 208) to a picatinny rail.

FIG. 23 shows a combined unit 100 positioned in a casing 200 that has a top portion configured to mount on the 200 picatinny rail of a gun. In this view the casing 200 is open to show combined unit 100 therein. FIG. 24 shows the opposite side of the casing 200 with the casing closed. Fastener 208 is used to close the top portion snuggly on a picatinny rail. 214 is an opening in canister 200 through which laser light can be emitted. FIG. 25 shows canister 200 in a side, perspective view. Rail 202, with groove 212A and rail 204, with groove 212B, can be tightened (using bolt 206 and nut 208) to a picatinny rail. Fastener 218 helps retain module 100 in casing 200 and button 216 changes the condition of module 100.

Figure 26:
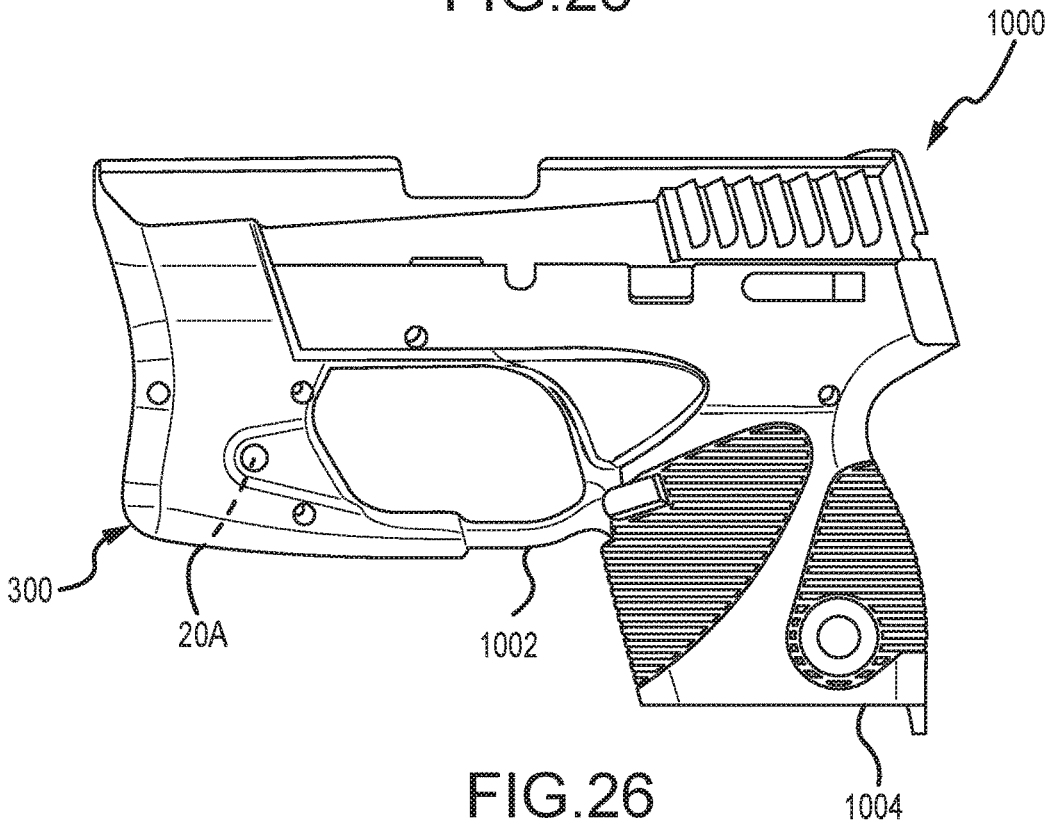
FIG. 26 shows a gun including a master module according to aspects of the invention.
Figure 27:
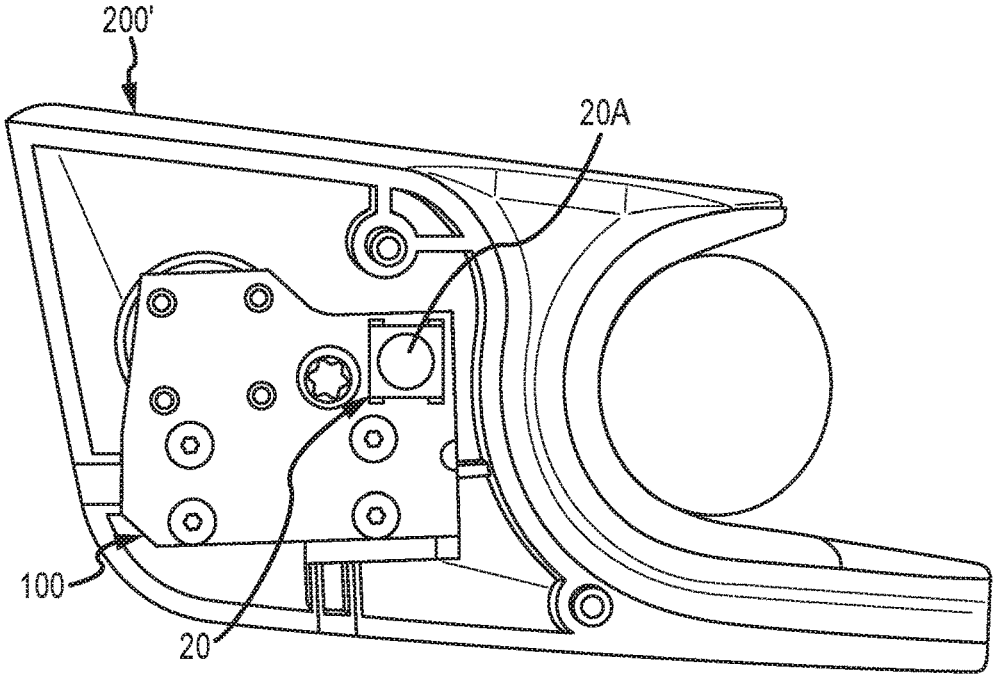
FIG. 27 shows a close-up, partial view of the gun of FIG. 26 with the casing side removed to expose the master module.
Figure 28:
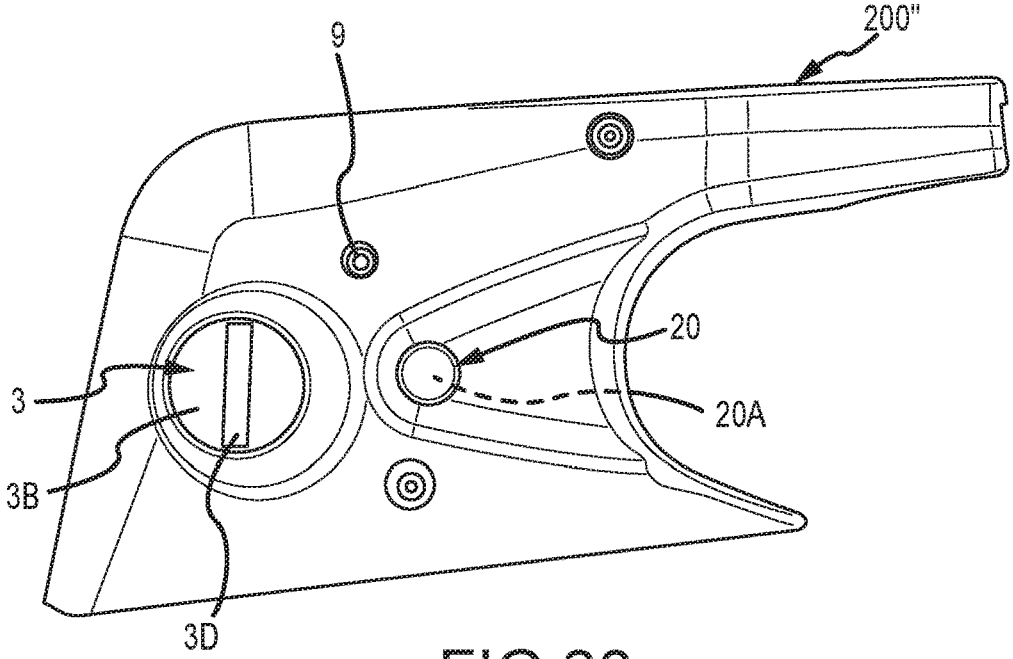
FIG. 28 shows a side view of a casing including a master module according to the invention.
Figure 29:
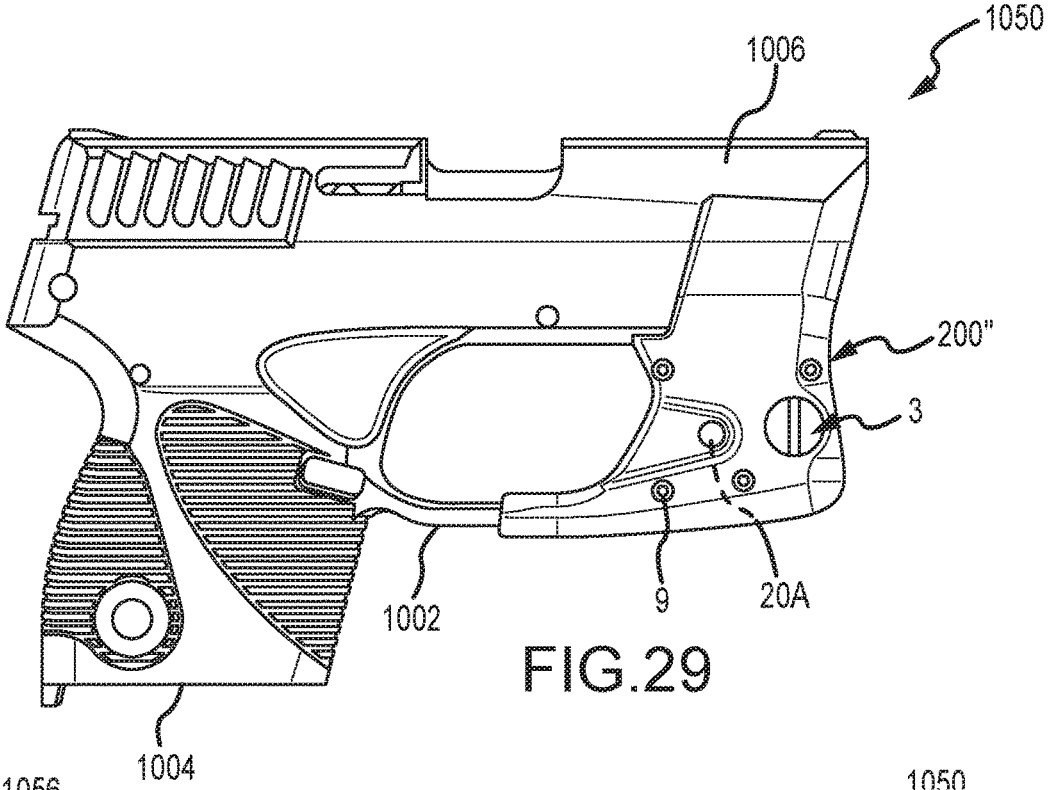
FIG. 29 is a side view of a gun including a casing having a master module in accordance with aspects of the invention.
Figure 30:
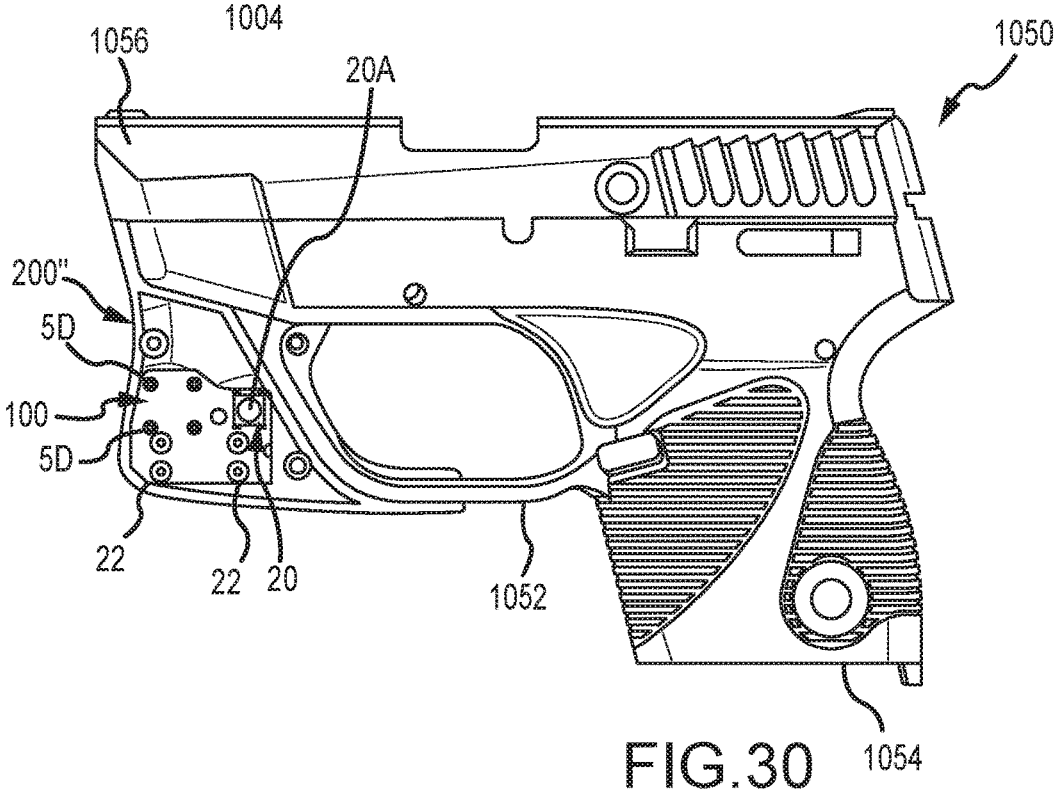
FIG. 30 shows the opposite side of the gun of FIG. 29 with part of the casing removed.

FIG. 26 shows another canister configuration 300 for fitting a different gun 1000 that utilizes a combined unit 100. Gun 1000 has a trigger guard 1002, a grip 1004, and a top portion 1006. FIG. 27 is another canister 200' that is open to show the placement of combined unit 100 therein. FIG. 28 shows another canister 200' that utilizes a combined unit 100. FIGS. 29-30 show a gun 1050 having a trigger guard 1052, a grip 1054, and top portion 1056. Gun 1050 utilizes the canister 200' of FIG. 28 and combined unit 100.

Figure 31:
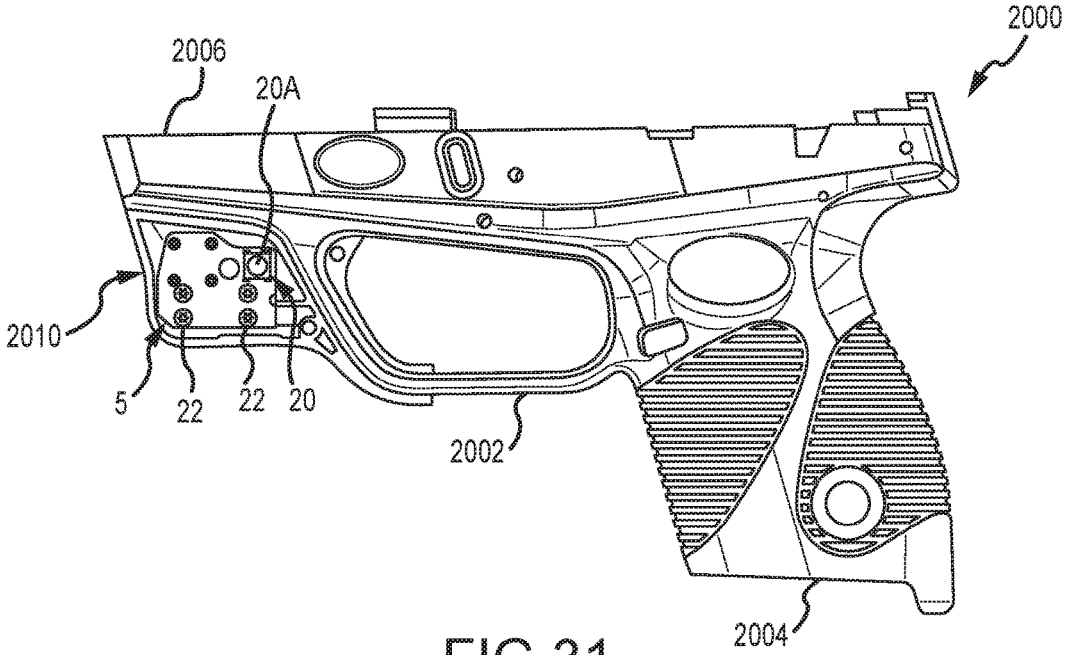
FIG. 31 shows another gun with the casing open to show a master module according to aspects of the invention.
Figure 32:
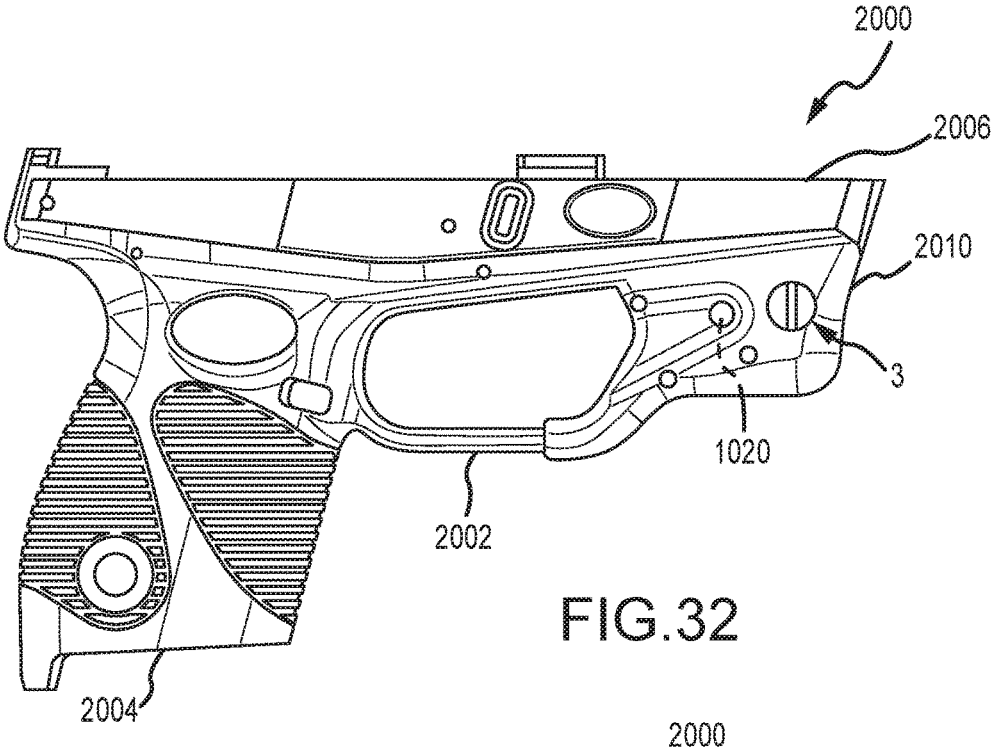
FIG. 32 shows one side of the gun of FIG. 31 including a casing with a master module in accordance with aspects of the invention.
Figure 33:
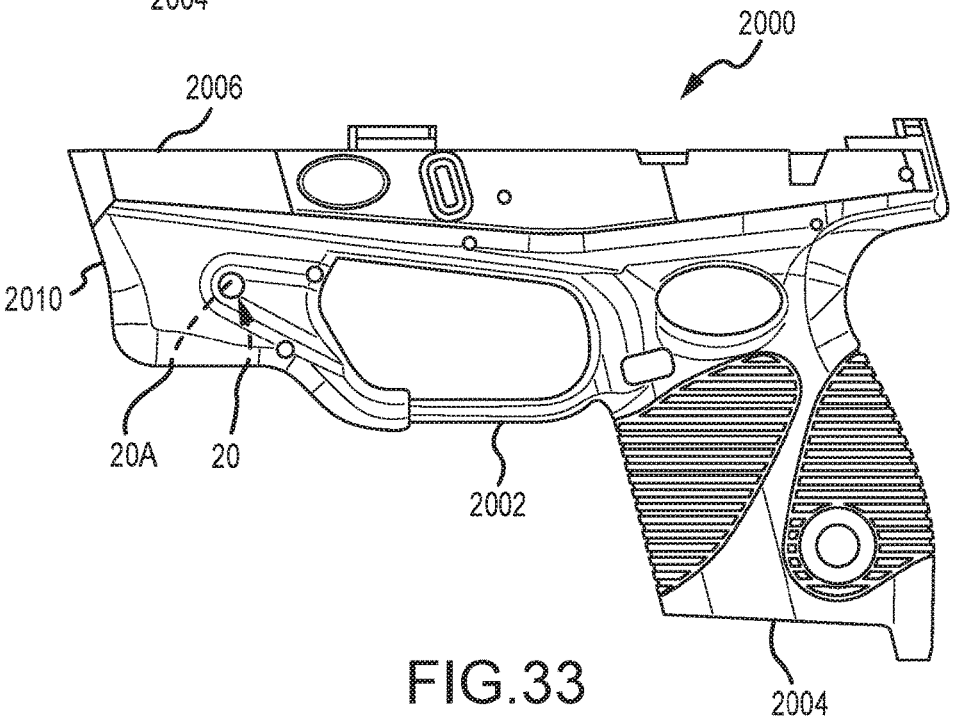
FIG. 33 shows the opposite side of the gun in FIG. 32.
Figure 34:
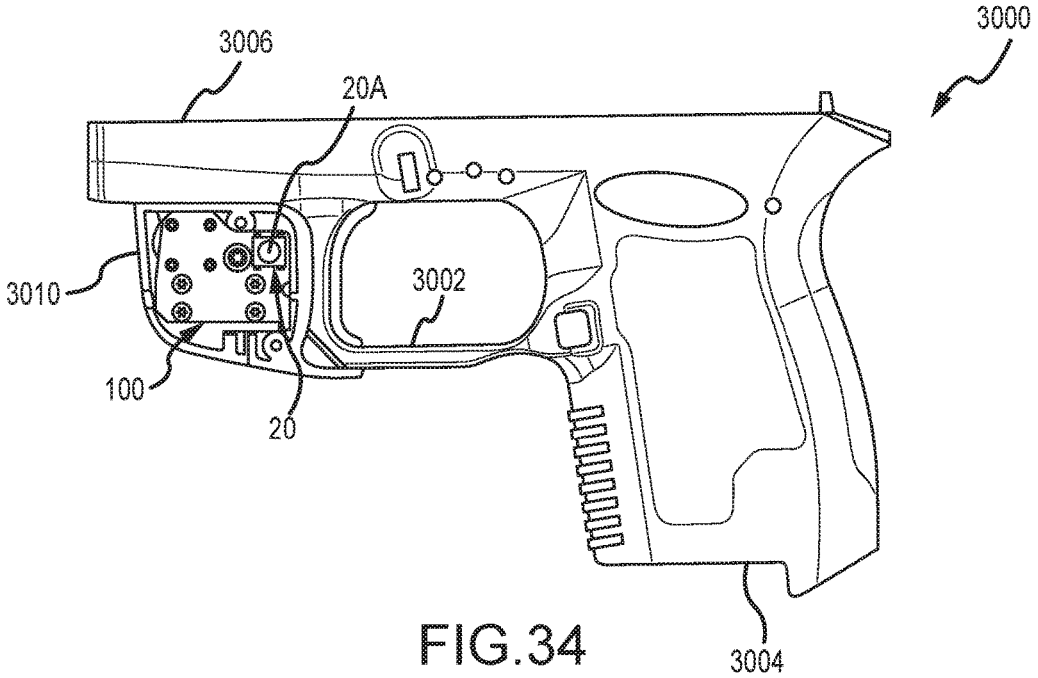
FIG. 34 shows a side view of an alternate gun with a casing open to show a master module in accordance with aspects of the invention.
Figure 35:
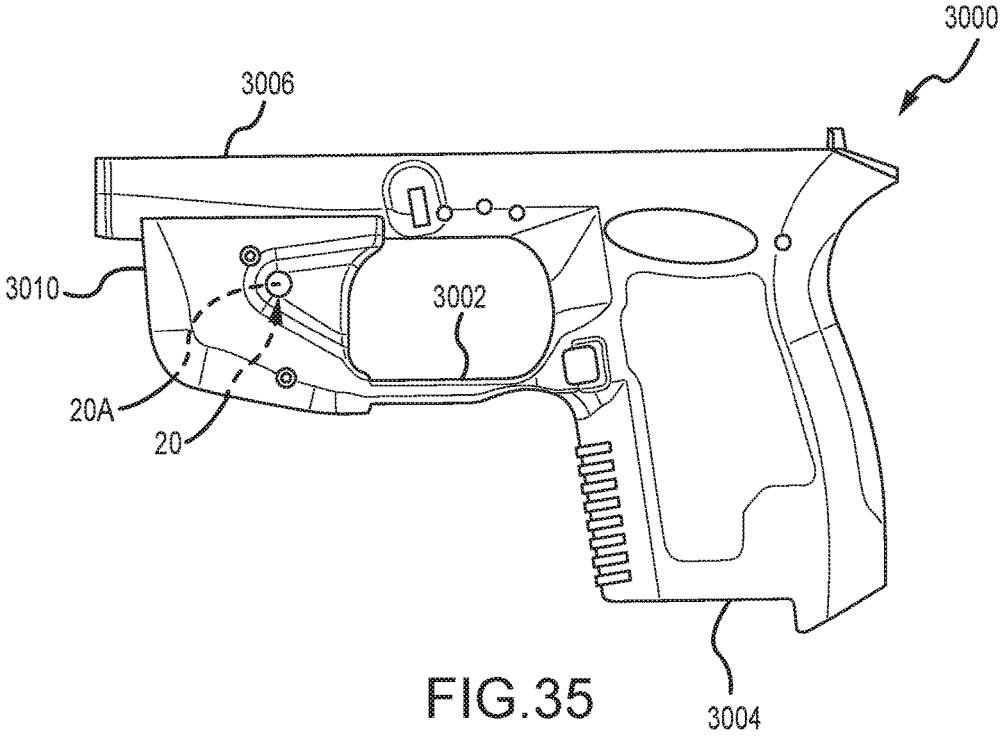
FIG. 35 shows the gun of FIG. 34 with the casing enclosing the master module.

FIGS. 31-33 show a gun 2000 with a canister 2010 including a combined unit 100 according to the invention. FIGS. 34-35 show a gun 3000 having a trigger guard 3002, a grip 3004, and a top portion 3006. A cannister 3010 including a combined unit 100 according to the invention is retained in cannister 3010.

Figure 36:
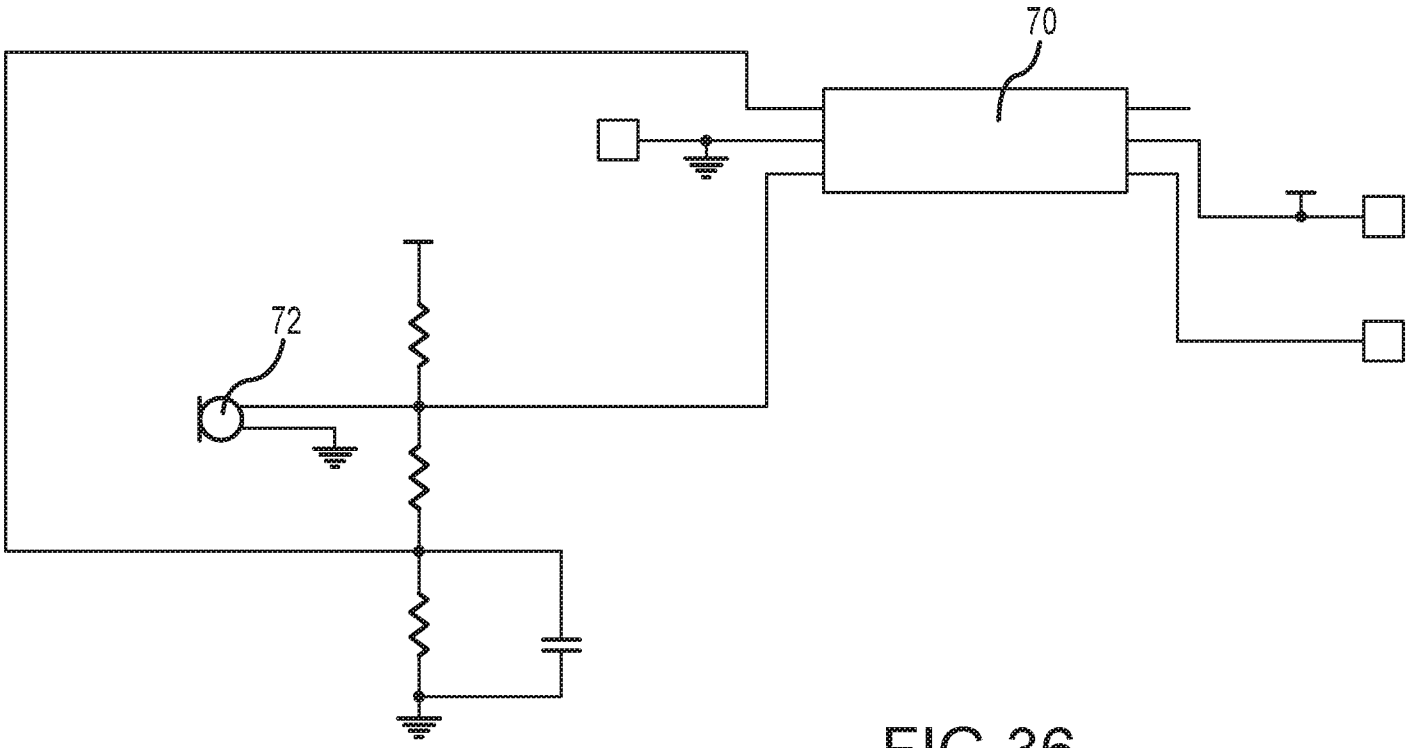
FIG. 36 is a schematic diagram of electronic components used to activate a light source when the sound of a firing pin is detected in accordance with aspects of the invention.
Figure 37:
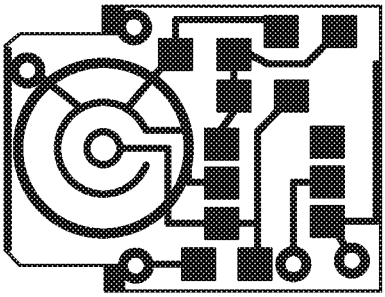
FIG. 37 shows printed traces on a first side of a module mount board for a sound-activated laser.
Figure 38:
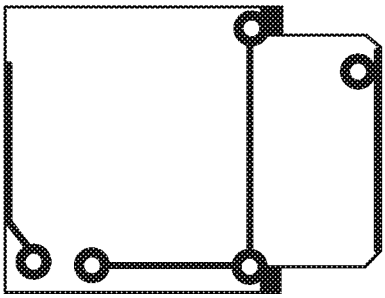
FIG. 38 shows printed traces on the second side of the module mount board of FIG. 37.
Figure 39:
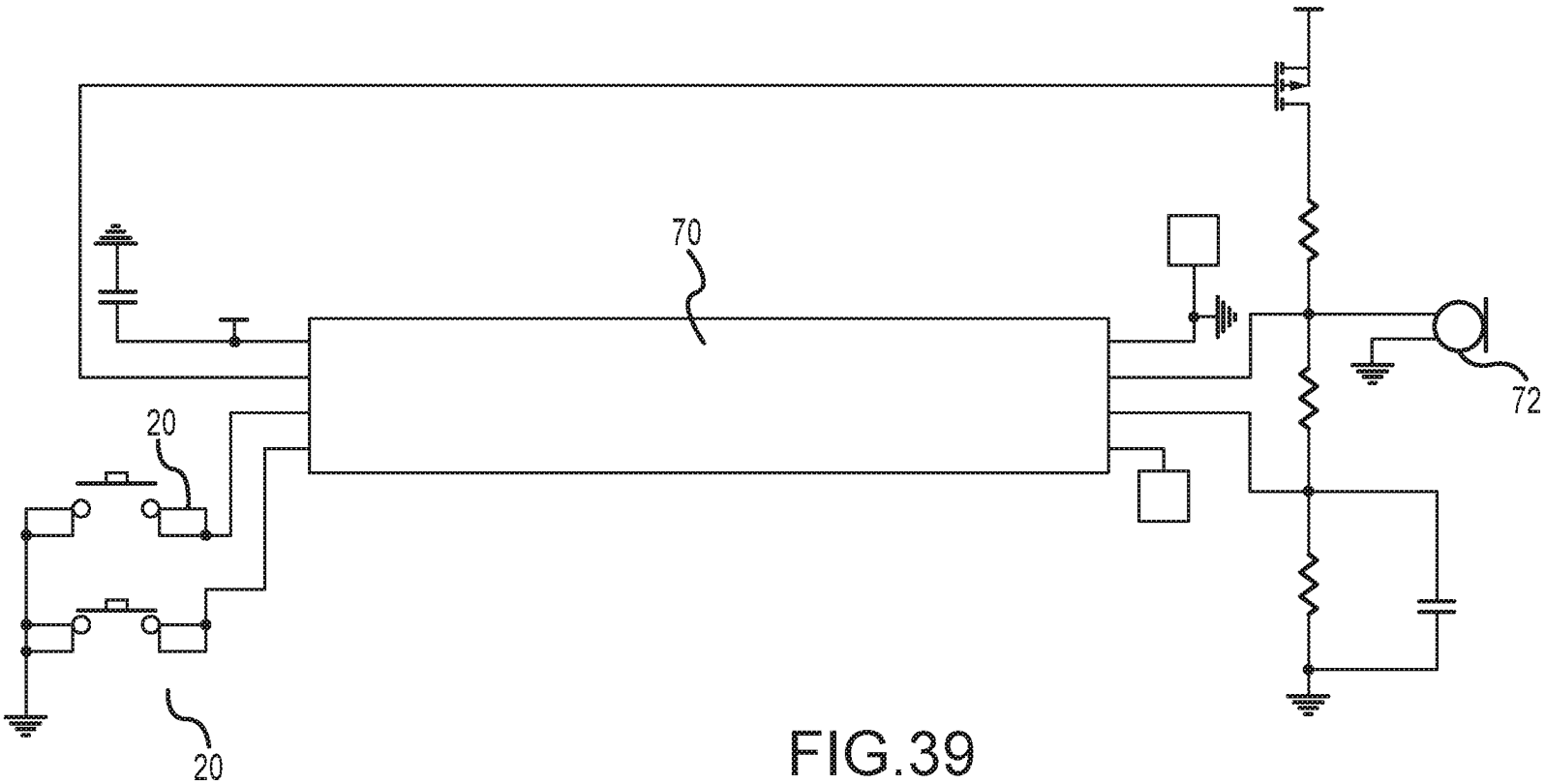
FIG. 39 is a schematic diagram of electronic components of a master module in accordance with aspects of the invention.

FIG. 36 shows a circuit diagram and corresponding part listing for a combined unit 100 having a single, sound-activated mode. Combined unit 100 may be controlled by a microprocessor 70, for example a PIC10F204 microprocessor offered by MicroChip Corporation of Chandler, Ariz. A compact, omnidirectional microphone 72, for example an EM4013SMT microphone offered by Shenzen Horn Audio Company, is connected to microprocessor 70. Responsive to detection of a particular acoustic signature received at microphone 72, such as the sound of the firing pin of a gun, microprocessor 70 activates laser module 8 to deliver a pulse of light, for example a pulse of approximately 100 milliseconds. In this manner, combined unit 100 may be utilized for training without the use of live ammunition. Microprocessor 70, microphone 72, and other components of combined unit 100 may be mechanically and electrically coupled to one another via module mount board 5 and the traces thereon illustrated in FIG. 37 and FIG. 38.

Figure 40:
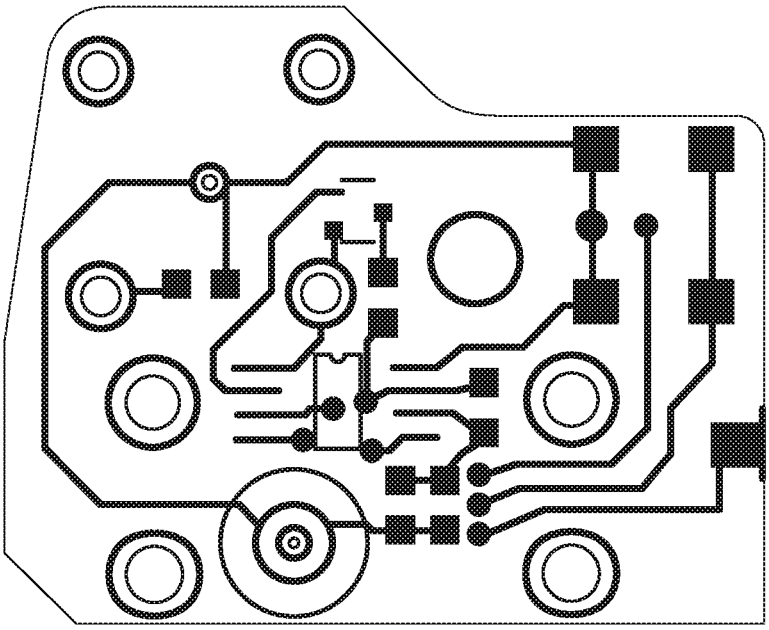
FIG. 40 shows printed traces on a first side of a module mount board of a master module in accordance with aspects of the invention.

FIG. 40 shows a circuit diagram and corresponding part listing for another exemplary combined unit 100. In accordance with these aspects of the invention, combined unit 100 may be configured with multiple operational modes. In a first mode, combined unit 100 continuously activates laser module 8 responsive to a first configuration of a switch 20 (or multiple switches). In this manner, combined unit 100 may emit a continuous laser beam for targeting purposes. In a second operational mode, combined unit 100 activates laser module 8 for a limited duration pulse, responsive to a second configuration of a switch 20 (or multiple switches) and responsive to detection of a particular acoustic signature received at microphone 72. In this manner, combined unit 100 may be utilized to emit a pulse from laser module 8 only after detection of the sound of a firing pin. In other words, in accordance with these aspects of the invention a single combined unit 100 may be suitable for use as a targeting laser during live shooting, yet also suitable for training without live ammunition. Combined unit 100 may be toggled between operational modes via operation of switch 20.

Figure 41:
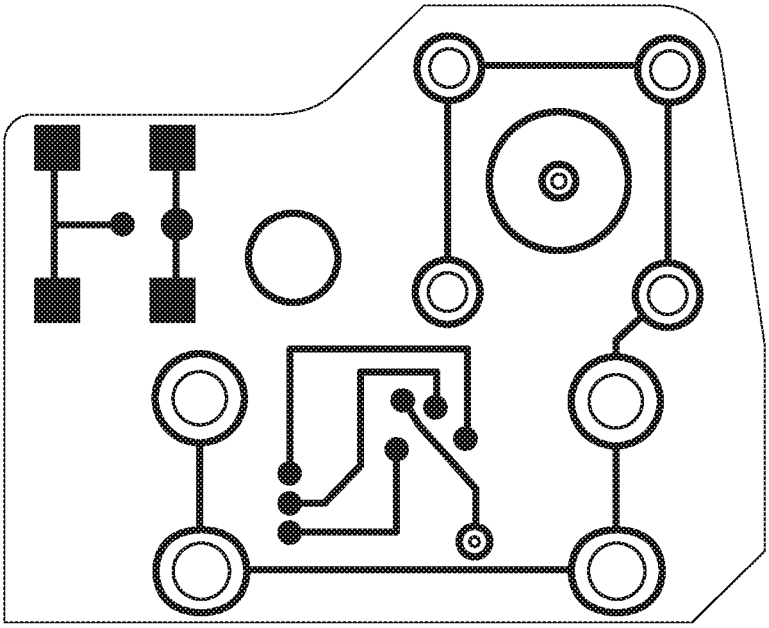
FIG. 41 shows printed traces on the second side of the module mount board of FIG. 40.

In these aspects of the invention, combined unit 100 may utilize a microprocessor 70 having a higher pin count, for example a PIC12F1571 microprocessor offered by MicroChip Corporation. In this manner, microprocessor 70 may accommodate the control inputs from microphone 72 as well as switch(es) 20. Microprocessor 70, microphone 72, and other components of combined unit 100 may be mechanically and electrically coupled to one another via module mount board 5 and the traces thereon illustrated in FIG. 40 and FIG. 41.

Figure 42:
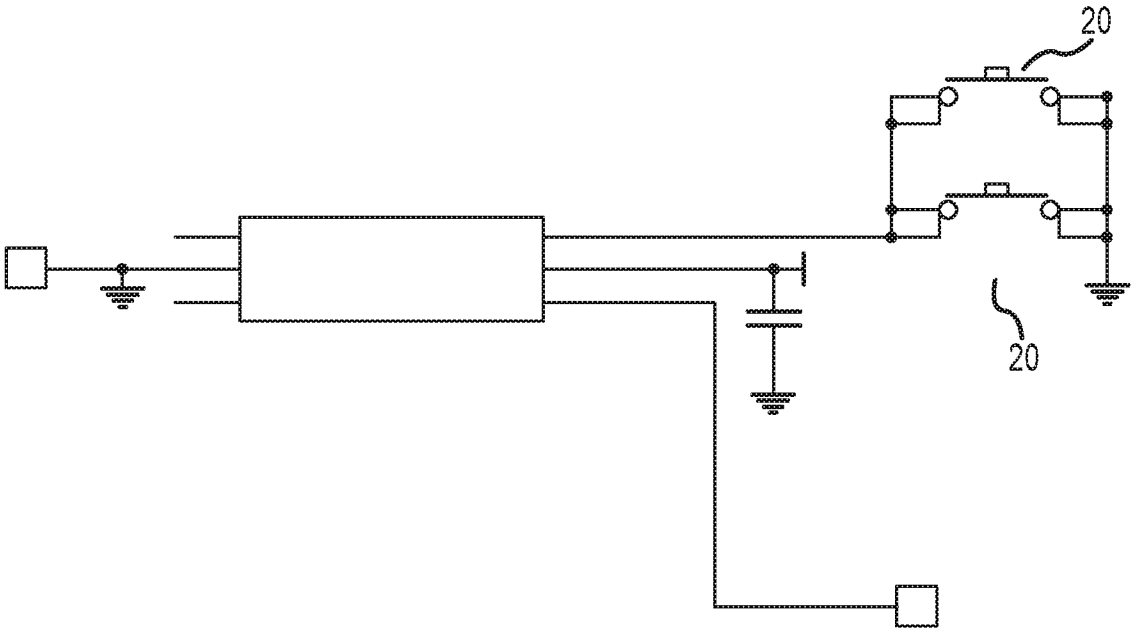
FIG. 42 is a schematic diagram of electronic components of a master module in accordance with aspects of the invention.
Figure 43:
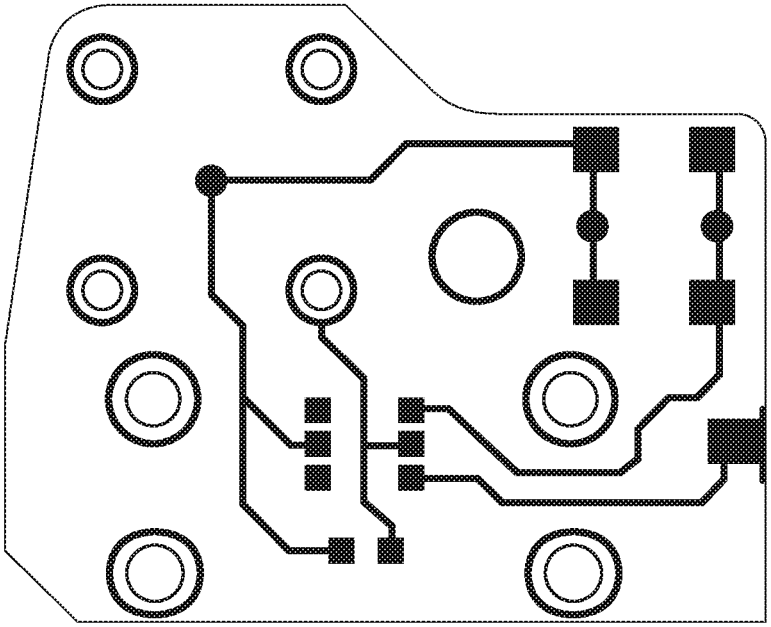
FIG. 43 shows printed traces on a first side of a module mount board of a master module in accordance with aspects of the invention.
Figure 44:
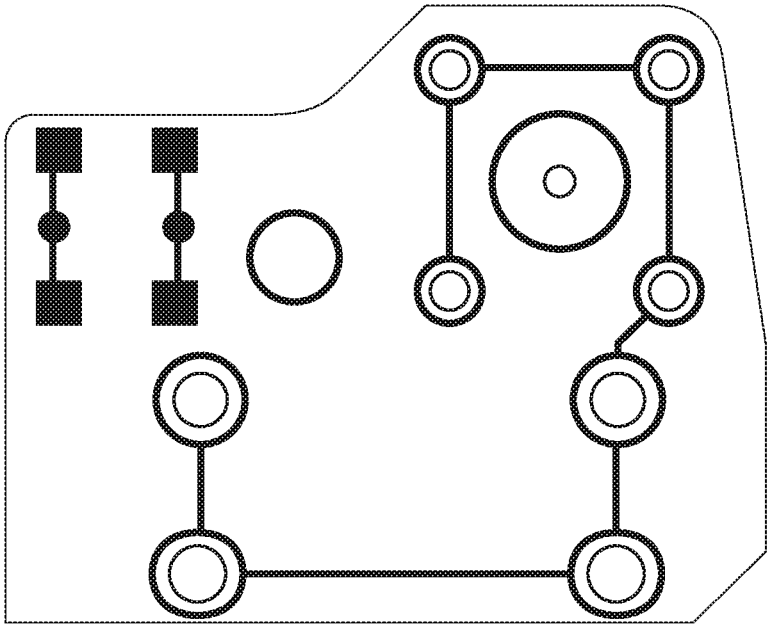
FIG. 44 shows printed traces on the second side of the module mount board of FIG. 43.

FIG. 42 shows a circuit diagram and corresponding part listing for an exemplary combined unit 100 having a single, switch-activated mode. Microprocessor 70 and other components of combined unit 100 may be mechanically and electrically coupled to one another via module mount board 5 and the traces thereon illustrated in FIG. 43 and FIG. 44.

Some specific examples of the invention follows:

1. A combined unit for providing (a) a light source wherein the light source has a first control position wherein it emits light and a second control position wherein it does not emit light, (b) a power source, and (c) a control device to control the power provided to the light source, wherein the light source has a casing and is positioned in a block housing, the block housing having an opening aligning with a lens of the light source to enable light to be emitted outward from the block housing, and at least one surface to which at least part of the control device is mounted.

2. The unit of example 1 wherein the control device is a first circuit board and a second circuit board in electrical communication with the first circuit board.

3. The unit of example 2 wherein the second circuit board is at a right angle to the first circuit board.

4. The unit of either of examples 2 or 3 wherein the first circuit board has an electrical contact on an edge and the second circuit board has an electrical contact on an edge and the respective contacts touch to form an electrical connection when the unit is assembled.

5. The unit of example 4 wherein the electrical contacts are soldered together.

6. The unit of any of examples 2-5 wherein the second circuit board has a through bolt hole in communication with an end of the light source opposite its lens.

7. The unit of example 6 wherein the through bolt hole is plated.

8. The unit of example 7 or 8 wherein a spring is retained in the through bolt hole.

9. The unit of example 8 wherein the spring is soldered in the through bolt hole.

10. The unit of example 8 or 9 wherein the spring biases the light source away from the spring.

11. The unit of any of examples 8-10 wherein the spring provides a negative contact for the light source.

12. The unit of any of examples 1-11 wherein the block housing is comprised of a conductive material.

13. The unit of any of examples 2-11 wherein the second circuit board is connected to the block housing.

14. The unit of example 2 wherein the second circuit board is connected to the block housing by fasteners, the block housing is comprised of a conductive material and the fasteners provide a positive charge to the light source.

15. The unit of example 1 wherein power from the power source travels through the first circuit board to reach the light source.

16. The unit of example 15 wherein power from the power source travels through the first circuit board and second circuit board to reach the light source.

17. The unit of any of examples 1-16 wherein the light source is a laser.

18. The unit of any of examples 2-17 wherein the material block has at least two sides and the first circuit board is connected to one of the sides and the second circuit board is connected to another of the sides.

19. The unit of any of examples 1-18 wherein the power source is in a casing that is connected to the first circuit board.

20. The unit of any of examples 1-19 wherein the power source is one or more batteries.

21. The unit of any of examples 1-20 wherein the material block includes a plurality of openings that extend from an outside surface of the material block to the light source casing, wherein one opening aligns with the lens of the light source, and two of the openings are each configured to receive an adjustment device capable of moving the light source within the material block.

22. The unit of example 21 wherein each adjustment device is a set screw.

23. The unit of example 21 or 22 wherein one of the adjustment devices moves the light source from side to side and the other adjustment device moves the light source up and down.

24. The unit of any of examples 1-23 that is configured to cause the light source to operate in any of the following modes: stay constantly on, stay constantly off, blink, or turn from the on position to the off position after a predetermined period of time.

25. The unit of any of examples 1-24 that includes one or more switches to change the mode of operation of the light source.

26. The unit of example 25 wherein the one or more switches is on the first circuit board or the control device.

27. The unit of any of examples 2-26 wherein the first circuit board is attached to one side of the material block, the battery casing is attached to the first circuit board, and extends outward over a top of the material block.

28. The unit of any of examples 1-27 wherein the material block is comprised of a conductive material, such as aluminum, or an injection-molded conductive plastic.

29. The unit of any of examples 1-28 wherein the power source is three batteries.

30. The unit of any of examples 1-29 wherein the power source is enclosed in a casing.

31. The unit of any of examples 1-30 wherein the power source is surrounded by an insulating sleeve.

32. The unit of example 30 wherein the casing includes a cap on its end for removing and replacing the power source.

33. The unit of any of examples 1-32 wherein the light source has a first end through which light is emitted and the first end is retained in a module cushion ball inside the material block.

34. A unit casing mountable to a firearm, the casing including a cavity that receives and provides weather protection to a unit of any of examples 1-33.

35. The unit casing of example 34 that is formed of plastic.

36. The unit casing of example 34 or 35 that is formed in two pieces.

37. The unit casing of any of examples 34-36 that forms a channel that retains the front of a trigger guard of a gun.

38. The unit casing of any of examples 34-37 that, when assembled, has an opening that aligns with the lens on the light source to permit light to emit therefrom, has an opening to allow access to a side-to-side adjustment mechanism that adjusts the position of the light source, has an opening to allow access to an up-and-down adjustment mechanism that adjusts the position of the light source, and an opening to permit access to a battery cap, so that the power source may be removed and replaced.

39. The unit casing of any of examples 34-38 that is configured to fit on a part of a pistol between the front portion of the trigger guard and the lower surface of the barrel in front of the trigger guard.

40. A kit comprising a plurality of unit casings of different sizes and a combination unit of any of claims 1-33 that is not positioned in any unit casing, but is configured to be positioned in any one of the unit casings.

41. The kit of example 40 that has two unit casings.

42. The kit of example 40 that has one combination unit.

43. The kit of example 40 that has more than two unit casings and one combination unit.

44. The kit of example 40 that has more than two unit casings, and more than one combination unit wherein there are fewer combination units than unit casings.

45. The unit casing of any of examples 34-39 wherein the unit is attached to the casing by a single fastener.

46. The unit casing of example 45 that has two parts and the unit is attached to one of the two parts.

47. The kit of any of examples 40-44 wherein the unit is connected to the unit casing by a single fastener.

48. The unit casing of any of examples 34-39 or 45-46 that has a switch button on either side wherein each of the switch buttons is in contact with a respective switch on the first circuit board or the control device.

49. The kit of any of examples 40-44 or 47 wherein each of the casings includes one long switch button and one short switch button wherein each switch button is configured to contact a respective switch on the combination unit when the casing is assembled with the combination unit inside.

50. The unit of example 2 or 3 wherein the second circuit board is in electrical communication with the block housing.

51. A casing including a combination unit of any of examples 1-33, the casing configured to fit on the picatinny rail of a gun.

52. The casing of example 1 that has two rail grasping members and a threaded fastener therebetween, the fastener capable of being tightened to pull the grasping members towards one another and tighten them to the picatinny rail.

53. The combined unit of example 1 wherein the control source is a plurality of circuit boards.

54. The combined unit of example 53 wherein each of the circuit boards is connected to the block housing.

55. The unit casing of any of examples 34-38, 45-46 or 48 that includes one long switch button and one short switch button wherein each switch button is configured to contact a respective switch on the combination unit when the casing is assembled with the combination unit inside.

Having thus described preferred embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A device configured to fit inside of a casing that mounts under a barrel and in front of a trigger guard of a gun, the device including: (a) a light source having a first operating mode and a second operating mode, and a first switch to select either the first operating mode or the second operating mode, wherein when the light source is in the first operating mode it has a first control position wherein it emits light and a second control position wherein it does not emit light, and when the light source is in the second operating mode it emits light when it detects the sound of a gun firing pin, (b) a power source, (c) a control device to control the power provided to the light source; (d) wherein the control device is a first circuit board and a second circuit board in electrical communication with the first circuit board, and physically connected to the first circuit board; and (e) the light source is positioned in a block housing and the power source is one or more batteries positioned in a battery container, and the block housing and battery container are each physically connected to the second printed circuit board.

2. The device of claim 1, wherein the second circuit board is at a right angle to the first circuit board.

3. The device of claim 1, wherein the first circuit board has an electrical contact on an edge and the second circuit board has an electrical contact on an edge and the respective contacts touch to form an electrical connection when the device is assembled.

4. The device of claim 3, wherein the electrical contacts are soldered together.

5. The device of claim 4, wherein the second circuit board has a through bolt hole in communication with an end of the light source opposite its lens.

6. The device of claim 5, wherein the through bolt hole is plated.

7. The device of claim 6, wherein a spring is retained in the through bolt hole.

8. The device of claim 7, wherein the spring is soldered in the through bolt hole.

9. The device of claim 7, wherein the spring biases the light source away from the spring.

10. The device of claim 7, wherein the spring provides a negative contact for the light source.

11. The device of claim 1, wherein the block housing is comprised of a conductive material.

12. The device of claim 1, wherein the first circuit board is physically connected to the block housing.

13. The device of claim 1, wherein the second circuit board is physically connected to the block housing by fasteners, the block housing is comprised of a conductive material and the fasteners provide a positive charge to the light source.

14. The device of claim 1, wherein power from the power source travels through the first circuit board to reach the light source.

15. The device of claim 14, wherein power from the power source travels through the first circuit board and second circuit board to reach the light source.

16. The device of claim 1, wherein the light source is a laser.

17. The device of claim 1, wherein the block housing has at least two sides and the first circuit board is connected to one of the sides and the second circuit board is connected to another of the sides.

18. The device of claim 1, wherein the light source has a casing and is positioned in a block housing, the block housing having an opening aligning with a lens of the light source to enable light to be emitted outward from the block housing, and at least one surface to which at least part of the control device is mounted.

19. The device of claim 1, wherein the battery container has a longitudinal axis, the light source is a laser module that has a longitudinal axis, wherein the longitudinal axis of the battery container is perpendicular to the longitudinal axis of the laser module.

20. The device of claim 1, wherein the first circuit board includes an opening through which light from the light source is projected.

21. A casing with the device of claim 1 mounted inside.

22. The device of claim 3, wherein solder forms at least part of the physical connection between the second circuit board and the first circuit board.

23. The device of claim 1, wherein solder forms at least part of the physical connection between the second circuit board and the first circuit board.

* * * * *